US008419598B2

(12) United States Patent
Dyer et al.

(10) Patent No.: US 8,419,598 B2
(45) Date of Patent: Apr. 16, 2013

(54) ADJUSTABLE TOTAL BODY CROSS-TRAINING EXERCISE DEVICE

(75) Inventors: David E. Dyer, Renton, WA (US); Gregory B. May, Seattle, WA (US); Peter J. Arnold, Snohomish, WA (US); Jonathan M. Stewart, Seattle, WA (US); Robert Silbernagel, Sammamish, WA (US)

(73) Assignee: Precor Incorporated, Woodenville, WA (US)

( * ) Notice: Subject to any disclaimer, the term of this patent is extended or adjusted under 35 U.S.C. 154(b) by 1703 days.

(21) Appl. No.: 11/342,936

(22) Filed: Jan. 30, 2006

(65) Prior Publication Data

US 2006/0189447 A1 Aug. 24, 2006

Related U.S. Application Data

(63) Continuation-in-part of application No. 11/054,376, filed on Feb. 9, 2005, now Pat. No. 7,731,634.

(51) Int. Cl.
*A63B 22/00* (2006.01)
*A63B 22/12* (2006.01)

(52) U.S. Cl.
USPC ..... 482/70; 482/51

(58) Field of Classification Search ..... 482/52, 482/62, 66, 70
See application file for complete search history.

(56) References Cited

U.S. PATENT DOCUMENTS

| | | | | |
|---|---|---|---|---|
| 219,439 | A | 9/1879 | Blend | |
| 518,757 | A | 4/1894 | Hoyt | |
| 1,323,004 | A | 11/1919 | Boyd | |
| 2,603,486 | A | 7/1952 | Hughes | 272/79 |
| 2,641,249 | A | 6/1953 | Brockman | 128/25 |
| 2,826,192 | A | 4/1958 | Mangas | 128/25 |
| 2,892,455 | A | 6/1959 | Hutton | 128/25 |
| 3,316,898 | A | 5/1967 | Brown | 128/25 |
| 3,432,164 | A | 3/1969 | Deeks | 272/73 |
| 3,475,021 | A | 10/1969 | Ruegsegger | 272/57 |
| 3,566,861 | A | 3/1971 | Weiss | 128/25 |
| 3,713,438 | A | 1/1973 | Knutsen | 128/25 |

(Continued)

FOREIGN PATENT DOCUMENTS

| | | | |
|---|---|---|---|
| EP | 1004332 | A2 * | 5/2000 |
| EP | 1666103 | A2 * | 6/2006 |

(Continued)

*Primary Examiner* — Loan Thanh
*Assistant Examiner* — Sundhara Ganesan
(74) *Attorney, Agent, or Firm* — Terence P. O'Brien; Todd A. Rathe; Paul E. Schaafsma

(57) ABSTRACT

An elliptical exercise device including a frame having a pivot axis, a foot link, a coupling, a swing arm, an engagement mechanism, and a guide system. The foot link has rearward, forward and foot support portions. The foot support portion has a central location. The coupling couples the rearward portion to the pivot axis so that the rearward portion of each foot link travels in a closed path relative to the pivot axis. The engagement mechanism has a first portion coupled to the swing arm and a second portion coupled to the foot link at a location rearward of the central location. The guide system supports the forward portion of the foot link along a preselected reciprocating path of travel as the rearward portion of the foot link travels along its path of travel. The guide system is selectably positionable in a plurality of different positions.

19 Claims, 13 Drawing Sheets

U.S. PATENT DOCUMENTS

| | | | | | |
|---|---|---|---|---|---|
| 3,759,511 | A | | 9/1973 | Zinkin et al. | 272/58 |
| 3,824,994 | A | | 7/1974 | Soderberg, Sr. | 128/25 |
| 4,023,795 | A | | 5/1977 | Pauls | 272/97 |
| 4,053,173 | A | | 10/1977 | Chase, Sr. | 280/253 |
| 4,185,622 | A | | 1/1980 | Swenson | 128/25 |
| 4,188,030 | A | | 2/1980 | Hooper | 272/73 |
| 4,379,566 | A | | 4/1983 | Titcomb | 280/251 |
| 4,456,276 | A | | 6/1984 | Bortolin | 280/257 |
| 4,505,473 | A | | 3/1985 | Pro | 272/73 |
| 4,509,742 | A | | 4/1985 | Cones | 272/73 |
| 4,561,318 | A | | 12/1985 | Schirrmacher | 74/54 |
| 4,645,200 | A | | 2/1987 | Hix | 272/73 |
| 4,679,786 | A | | 7/1987 | Rodgers | 272/70 |
| 4,700,946 | A | | 10/1987 | Breuning | 482/142 |
| 4,720,093 | A | | 1/1988 | Del Mar | 272/70 |
| 4,726,600 | A | * | 2/1988 | Wu | 280/234 |
| 4,733,858 | A | | 3/1988 | Lan | 482/53 |
| 4,779,863 | A | | 10/1988 | Yang | 272/114 |
| 4,786,050 | A | | 11/1988 | Geschwender | 272/73 |
| 4,911,438 | A | | 2/1989 | Van Straaten | 482/96 |
| 4,842,268 | A | | 6/1989 | Jenkins | 272/73 |
| 4,869,494 | A | | 9/1989 | Lambert, Sr. | 272/73 |
| 4,900,013 | A | | 2/1990 | Rodgers, Jr. | 272/70 |
| 4,949,954 | A | | 8/1990 | Hix | 272/73 |
| 4,949,993 | A | | 8/1990 | Stark et al. | 272/70 |
| 4,986,261 | A | | 1/1991 | Iams et al. | 128/25 |
| 4,989,857 | A | | 2/1991 | Kuo | 272/70 |
| 5,039,087 | A | | 8/1991 | Kuo | 272/70 |
| 5,039,088 | A | | 8/1991 | Shifferaw | 272/73 |
| 5,131,895 | A | | 7/1992 | Rogers et al. | 482/70 |
| 5,135,447 | A | | 8/1992 | Robards, Jr. et al. | 482/52 |
| 5,139,255 | A | * | 8/1992 | Sollami | 482/58 |
| 5,149,312 | A | | 9/1992 | Croft et al. | 482/62 |
| D330,236 | S | | 10/1992 | Jarriel et al. | D21/194 |
| 5,169,363 | A | | 12/1992 | Campanaro et al. | 482/96 |
| 5,186,697 | A | | 2/1993 | Rennex | 482/52 |
| 5,242,343 | A | | 9/1993 | Miller | 482/57 |
| 5,269,736 | A | | 12/1993 | Roberts | 482/62 |
| 5,279,529 | A | | 1/1994 | Eschenbach | 482/57 |
| 5,279,530 | A | | 1/1994 | Hess | 482/70 |
| 5,290,211 | A | | 3/1994 | Stearns | 482/53 |
| 5,295,928 | A | | 3/1994 | Rennex | 482/52 |
| 5,299,993 | A | | 4/1994 | Habing | 482/52 |
| 5,352,169 | A | | 10/1994 | Eschenbach | 482/57 |
| 5,382,209 | A | | 1/1995 | Pasier et al. | 482/70 |
| 5,383,829 | A | | 1/1995 | Miller | 482/57 |
| 5,401,226 | A | | 3/1995 | Stearns | 482/53 |
| 5,403,255 | A | | 4/1995 | Johnston | 482/52 |
| 5,423,729 | A | | 6/1995 | Eschenbach | 482/70 |
| 5,499,956 | A | | 3/1996 | Habing et al. | 482/52 |
| 5,518,473 | A | | 5/1996 | Miller | 482/57 |
| 5,527,246 | A | | 6/1996 | Rodgers, Jr. | 482/57 |
| 5,529,554 | A | | 6/1996 | Eschenbach | 482/57 |
| 5,529,555 | A | | 6/1996 | Rodgers, Jr. | 482/57 |
| D372,282 | S | * | 7/1996 | Pasero et al. | D21/670 |
| 5,536,224 | A | | 7/1996 | Hsieh | 482/51 |
| 5,540,637 | A | | 7/1996 | Rodgers, Jr. | 482/52 |
| 5,549,526 | A | | 8/1996 | Rodgers, Jr. | 482/57 |
| 5,562,574 | A | | 10/1996 | Miller | 482/51 |
| 5,573,480 | A | | 11/1996 | Rodgers, Jr. | 482/57 |
| 5,593,371 | A | | 1/1997 | Rodgers, Jr. | 482/51 |
| 5,593,372 | A | | 1/1997 | Rodgers, Jr. | 482/52 |
| 5,595,553 | A | | 1/1997 | Rodgers, Jr. | 482/51 |
| 5,620,403 | A | | 4/1997 | Lundin | 482/96 |
| 5,637,058 | A | | 6/1997 | Rodgers, Jr. | 482/51 |
| 5,653,662 | A | | 8/1997 | Rodgers, Jr. | 482/52 |
| 5,683,333 | A | | 11/1997 | Rodgers, Jr. | 482/57 |
| 5,685,804 | A | | 11/1997 | Whan-Tong et al. | 482/51 |
| 5,690,589 | A | | 11/1997 | Rodgers, Jr. | 482/57 |
| D388,847 | S | * | 1/1998 | Whan-Tong et al. | D21/670 |
| 5,738,614 | A | | 4/1998 | Rodgers, Jr. | 482/51 |
| 5,743,834 | A | | 4/1998 | Rodgers, Jr. | 482/57 |
| 5,766,113 | A | | 6/1998 | Rodgers, Jr. | 482/52 |
| 5,772,558 | A | | 6/1998 | Rodgers, Jr. | 482/51 |
| 5,779,598 | A | | 7/1998 | Lee | 482/57 |
| 5,779,599 | A | * | 7/1998 | Chen | 482/57 |
| 5,782,722 | A | * | 7/1998 | Sands et al. | 482/52 |
| 5,830,112 | A | | 11/1998 | Wang et al. | 482/52 |
| D405,852 | S | | 2/1999 | McBride | D21/670 |
| 5,868,650 | A | * | 2/1999 | Wu | 482/62 |
| D408,477 | S | * | 4/1999 | Arnold et al. | D21/668 |
| 5,895,339 | A | | 4/1999 | Maresh | 482/51 |
| D410,978 | S | * | 6/1999 | Littrell et al. | D21/668 |
| 5,916,065 | A | | 6/1999 | McBride et al. | 482/57 |
| 5,919,118 | A | * | 7/1999 | Stearns et al. | 482/51 |
| 5,938,568 | A | * | 8/1999 | Maresh et al. | 482/51 |
| 5,997,445 | A | * | 12/1999 | Maresh et al. | 482/70 |
| 6,042,512 | A | * | 3/2000 | Eschenbach | 482/52 |
| 6,053,847 | A | * | 4/2000 | Stearns et al. | 482/51 |
| 6,063,008 | A | | 5/2000 | McBride et al. | 482/52 |
| 6,063,009 | A | * | 5/2000 | Stearns et al. | 482/52 |
| 6,080,086 | A | * | 6/2000 | Maresh et al. | 482/57 |
| 6,090,014 | A | * | 7/2000 | Eschenbach | 482/52 |
| D429,781 | S | * | 8/2000 | Arnold et al. | D21/668 |
| 6,146,313 | A | | 11/2000 | Whan-Tong et al. | 482/51 |
| 6,152,859 | A | * | 11/2000 | Stearns | 482/52 |
| 6,190,289 | B1 | * | 2/2001 | Pyles et al. | 482/52 |
| 6,196,948 | B1 | * | 3/2001 | Stearns et al. | 482/52 |
| 6,210,305 | B1 | * | 4/2001 | Eschenbach | 482/52 |
| 6,217,485 | B1 | * | 4/2001 | Maresh | 482/52 |
| 6,238,321 | B1 | * | 5/2001 | Arnold et al. | 482/52 |
| 6,248,045 | B1 | * | 6/2001 | Stearns et al. | 482/52 |
| 6,248,046 | B1 | * | 6/2001 | Maresh et al. | 482/57 |
| 6,254,514 | B1 | | 7/2001 | Maresh et al. | 482/52 |
| 6,277,054 | B1 | * | 8/2001 | Kuo | 482/51 |
| 6,277,056 | B1 | * | 8/2001 | McBride et al. | 482/57 |
| D449,356 | S | * | 10/2001 | Arnold et al. | D21/668 |
| 6,340,340 | B1 | * | 1/2002 | Stearns et al. | 482/52 |
| 6,361,476 | B1 | * | 3/2002 | Eschenbach | 482/52 |
| 6,390,954 | B1 | * | 5/2002 | Lee | 482/52 |
| 6,440,042 | B2 | * | 8/2002 | Eschenbach | 482/52 |
| D464,688 | S | * | 10/2002 | May et al. | D21/668 |
| D464,689 | S | * | 10/2002 | May et al. | D21/668 |
| D465,000 | S | * | 10/2002 | Arnold et al. | D21/668 |
| 6,482,130 | B1 | | 11/2002 | Pasero et al. | 482/51 |
| 6,485,395 | B1 | * | 11/2002 | Stearns et al. | 482/57 |
| 6,544,146 | B1 | * | 4/2003 | Stearns et al. | 482/52 |
| 6,569,061 | B2 | * | 5/2003 | Stearns et al. | 482/52 |
| 6,575,877 | B2 | | 6/2003 | Rufino et al. | 482/51 |
| 6,612,969 | B2 | * | 9/2003 | Eschenbach | 482/51 |
| 6,645,125 | B1 | * | 11/2003 | Stearns et al. | 482/52 |
| 6,659,915 | B2 | * | 12/2003 | Klein | 482/51 |
| 6,672,992 | B1 | * | 1/2004 | Lo et al. | 482/52 |
| 6,672,994 | B1 | * | 1/2004 | Stearns et al. | 482/57 |
| 6,689,019 | B2 | | 2/2004 | Ohrt et al. | 482/52 |
| 6,719,666 | B1 | * | 4/2004 | Lo et al. | 482/52 |
| 6,726,600 | B2 | * | 4/2004 | Miller | 482/51 |
| 6,749,540 | B1 | | 6/2004 | Pasero et al. | 482/52 |
| 6,752,744 | B2 | * | 6/2004 | Arnold et al. | 482/52 |
| 6,758,790 | B1 | * | 7/2004 | Ellis | 482/52 |
| 6,875,160 | B2 | * | 4/2005 | Watterson et al. | 482/57 |
| 6,905,442 | B1 | * | 6/2005 | Lee et al. | 482/52 |
| 6,939,271 | B1 | | 9/2005 | Whan-Tong et al. | 482/52 |
| 6,949,053 | B1 | * | 9/2005 | Stearns et al. | 482/52 |
| 6,994,656 | B2 | * | 2/2006 | Liao et al. | 482/52 |
| 7,025,711 | B2 | * | 4/2006 | Eschenbach | 482/52 |
| 7,037,242 | B2 | * | 5/2006 | Lo et al. | 482/52 |
| 7,041,035 | B1 | * | 5/2006 | Stearns et al. | 482/52 |
| 7,041,036 | B1 | * | 5/2006 | Kuo | 482/52 |
| 7,052,438 | B2 | * | 5/2006 | Eschenbach | 482/52 |
| 7,060,004 | B2 | * | 6/2006 | Kuo | 482/52 |
| 7,060,005 | B2 | * | 6/2006 | Carlsen et al. | 482/52 |
| 7,097,591 | B2 | * | 8/2006 | Moon | 482/52 |
| 7,169,087 | B2 | * | 1/2007 | Ercanbrack et al. | 482/52 |
| 7,182,714 | B2 | * | 2/2007 | Moon | 482/52 |
| 7,201,705 | B2 | * | 4/2007 | Rodgers, Jr. | 482/52 |
| 7,201,706 | B1 | * | 4/2007 | Lee et al. | 482/52 |
| 7,207,925 | B2 | * | 4/2007 | Moon | 482/52 |
| 7,214,167 | B2 | * | 5/2007 | Stearns et al. | 482/52 |
| 7,214,168 | B2 | * | 5/2007 | Rodgers, Jr. | 482/52 |
| 7,223,208 | B1 | * | 5/2007 | Chen et al. | 482/52 |
| 7,223,209 | B2 | * | 5/2007 | Lee | 482/52 |
| 7,226,392 | B2 | * | 6/2007 | Hong | 482/52 |
| 7,229,386 | B2 | * | 6/2007 | Wu et al. | 482/52 |
| 7,255,665 | B2 | * | 8/2007 | Ish, III | 482/102 |
| 7,267,638 | B2 | * | 9/2007 | Wang | 482/52 |
| 7,270,626 | B2 | * | 9/2007 | Porth | 482/52 |

| | | | | |
|---|---|---|---|---|
| 7,276,017 | B2 * | 10/2007 | Chen | 482/52 |
| 7,448,986 | B1 * | 11/2008 | Porth | 482/52 |
| 2001/0001305 | A1 * | 5/2001 | Stearns et al. | 482/66 |
| 2001/0012811 | A1 | 8/2001 | Gordon | 482/70 |
| 2001/0023219 | A1 * | 9/2001 | Arnold et al. | 482/57 |
| 2001/0051562 | A1 | 12/2001 | Stearns et al. | 482/51 |
| 2002/0016237 | A1 | 2/2002 | Schmidt | 482/70 |
| 2002/0094914 | A1 * | 7/2002 | Maresh et al. | 482/51 |
| 2002/0119867 | A1 * | 8/2002 | Stearns et al. | 482/52 |
| 2002/0123411 | A1 | 9/2002 | Stearns et al. | 482/52 |
| 2002/0193214 | A1 * | 12/2002 | Ish, III | 482/92 |
| 2004/0043871 | A1 * | 3/2004 | Chang | 482/52 |
| 2004/0053748 | A1 * | 3/2004 | Lo et al. | 482/52 |
| 2004/0097339 | A1 * | 5/2004 | Moon | 482/52 |
| 2004/0097340 | A1 * | 5/2004 | Liao et al. | 482/52 |
| 2004/0147375 | A1 * | 7/2004 | Stevens | 482/57 |
| 2004/0162191 | A1 * | 8/2004 | Ercanbrack et al. | 482/52 |
| 2004/0209741 | A1 * | 10/2004 | Kuo | 482/52 |
| 2005/0043145 | A1 * | 2/2005 | Anderson et al. | 482/52 |
| 2005/0049117 | A1 * | 3/2005 | Rodgers | 482/52 |
| 2005/0101445 | A1 * | 5/2005 | Chen | 482/52 |
| 2005/0130807 | A1 * | 6/2005 | Cutler et al. | 482/54 |
| 2005/0164835 | A1 * | 7/2005 | Porth | 482/52 |
| 2005/0209057 | A1 * | 9/2005 | Wang et al. | 482/52 |
| 2006/0009330 | A1 * | 1/2006 | Lo | 482/52 |
| 2006/0046903 | A1 * | 3/2006 | Liao et al. | 482/52 |
| 2006/0079381 | A1 * | 4/2006 | Cornejo et al. | 482/52 |
| 2006/0116247 | A1 * | 6/2006 | Dyer et al. | 482/52 |
| 2006/0142123 | A1 * | 6/2006 | Kettler et al. | 482/52 |
| 2006/0166791 | A1 * | 7/2006 | Liao et al. | 482/52 |
| 2006/0183605 | A1 * | 8/2006 | Dyer et al. | 482/52 |
| 2006/0189445 | A1 * | 8/2006 | Stewart et al. | 482/52 |
| 2006/0189447 | A1 * | 8/2006 | Dyer et al. | 482/52 |
| 2006/0199701 | A1 * | 9/2006 | May et al. | 482/52 |
| 2006/0217235 | A1 * | 9/2006 | Schroder | 482/52 |
| 2006/0234840 | A1 * | 10/2006 | Watson et al. | 482/61 |
| 2006/0252604 | A1 * | 11/2006 | Moon | 482/52 |
| 2006/0281604 | A1 * | 12/2006 | Stewart et al. | 482/51 |
| 2007/0001422 | A1 * | 1/2007 | Kraus | 280/200 |
| 2007/0015633 | A1 * | 1/2007 | Gerschefske et al. | 482/52 |
| 2007/0021274 | A1 * | 1/2007 | Moon | 482/52 |
| 2007/0060449 | A1 * | 3/2007 | Lo | 482/52 |
| 2007/0060450 | A1 * | 3/2007 | Lo | 482/52 |
| 2007/0072742 | A1 * | 3/2007 | Chen | 482/52 |
| 2007/0087903 | A1 * | 4/2007 | Lee et al. | 482/52 |
| 2007/0099763 | A1 * | 5/2007 | Wang | 482/52 |
| 2007/0117686 | A1 * | 5/2007 | Liao et al. | 482/52 |
| 2007/0219061 | A1 * | 9/2007 | Rodgers, Jr. | 482/52 |
| 2007/0219063 | A1 * | 9/2007 | Anderson et al. | 482/52 |
| 2007/0219064 | A1 * | 9/2007 | Anderson et al. | 482/52 |
| 2007/0232457 | A1 * | 10/2007 | Porth | 482/51 |

FOREIGN PATENT DOCUMENTS

| | | | |
|---|---|---|---|
| JP | 2003314437 | A * | 11/2003 |
| JP | 2006150084 | A * | 6/2006 |
| JP | 2006218287 | A * | 8/2006 |

* cited by examiner

FIG. 5
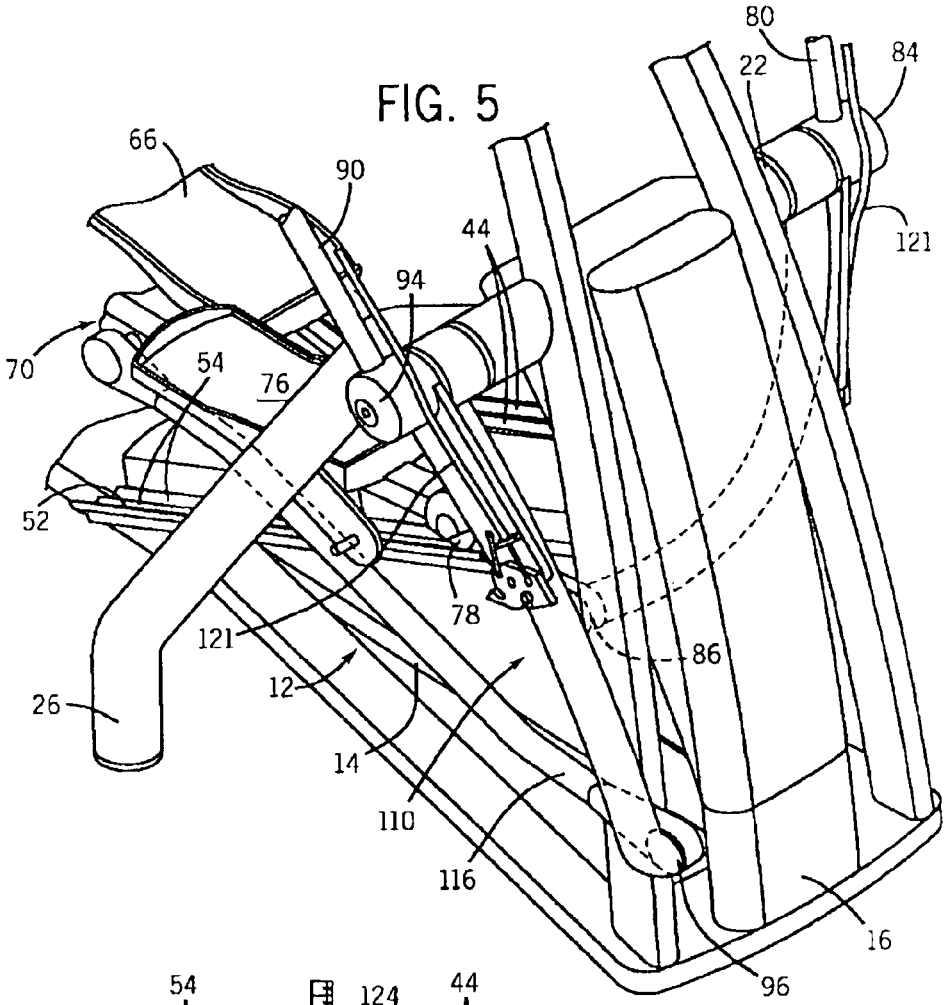
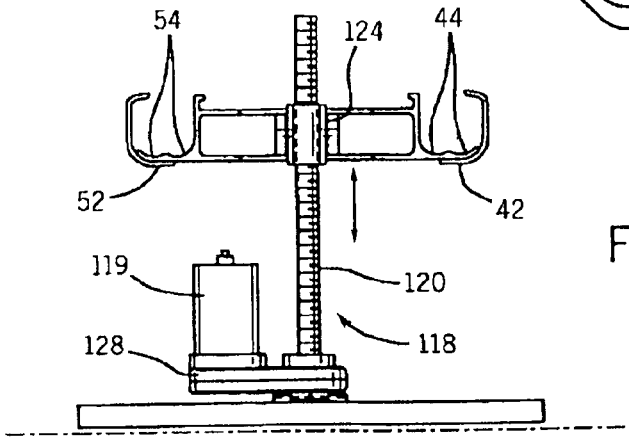
FIG. 6

12
20
126
132
80
84
121
123
130
141
136
127
12
132
126
90
94
121
123
130
141
136
127

ADJUSTABLE TOTAL BODY CROSS-TRAINING EXERCISE DEVICE

CROSS-REFERENCE TO RELATED PATENT APPLICATIONS

This application is a continuation-in-part of U.S. patent application Ser. No. 11/054,376 titled "Elliptical Exercise Equipment With Stowable Arms" and filed on Feb. 9, 2005 now U.S. Pat. No. 7,731,634.

FIELD OF THE INVENTION

The present invention relates to exercise equipment.

BACKGROUND OF THE INVENTION

The benefits of regular aerobic exercise are well established. However, due to time constraints, inclement weather, and other reasons, many people are prevented from aerobic activities such as walking, jogging, running, and swimming. In response, a variety of exercise equipment has been developed for aerobic activity. It is generally desirable to exercise a large number of different muscles over a significantly large range of motion so as to provide for balanced physical development, to maximize muscle length and flexibility, and to achieve optimum levels of aerobic exercise. It is further advantageous for exercise equipment to provide smooth and natural motion, thus avoiding significant jarring and straining that can damage both muscles and joints.

While various exercise systems are known in the prior art, these systems suffer from a variety of shortcomings that limit their benefits and/or include unnecessary risks and undesirable features. For example, stationary bicycles are a popular exercise system in the prior art; however, these machines employ a sitting position that utilizes only a relatively small number of muscles, through a fairly limited range of motion. Cross-country skiing devices are also utilized to simulate the gliding motion of cross-country skiing. While cross-country skiing devices exercise more muscles than stationary bicycles, the substantially flat shuffling foot motion provided by the ski devices limits the range of motion of some of the muscles being exercised. Another type of exercise device simulates stair climbing. These devices exercise more muscles than stationary bicycles; however, the rather limited range of up-and-down motion utilized does not exercise the leg muscles of the user through a large range of motion. Treadmills are still a further type of exercise device in the prior art. Treadmills allow natural walking or jogging motions in a relatively limited area. A drawback of the treadmill, however, is that significant jarring of the hip, knee, ankle and other joints of the body may occur through use of this device.

A further limitation of a majority of exercise systems in the prior art lies in the limits in the types of motions that they can produce. Relatively new classes of exercise devices are capable of producing elliptical motion. Exercise systems create elliptical motion, as referred to herein, when the path traveled by a user's feet while using the exercise system follows a generally arcuate or ellipse-shaped path of travel. Elliptical motion is much more natural and analogous to running, jogging, walking, etc., than the linear-type, back and forth motions produced by some prior art exercise equipment.

An initial drawback of such elliptical trainers was that the step height or angle from horizontal of the elliptical path that the feet traveled during use was fixed. Thus, such trainers provided only a single exercise motion that exercised only certain muscle groups. This drawback was solved by the use of an adjustable guide with which the user could adjust the angle of the elliptical path that the feet traveled relative to horizontal, thereby enabling different elliptical exercise motions to be used and different muscle groups to be exercised during use.

Another initial drawback of such elliptical trainers was that devices only exercised the lower part if the body. This drawback was solved by exercise devices that provide arm, shoulder, and general upper body motions as well as elliptical foot motions. These prior art devices utilize arm and shoulder motions that are linked to foot motions, where the motions of the feet of a user are linked to the motions of the arms and shoulders. One drawback to these linked devices is that, because of the complexity and geometry of the mechanism used to link the motions of the arms and shoulders to the foot motion, an adjustable guide with which the user could adjust the step height, or the angle of the elliptical path that the feet traveled relative to horizontal, could not be used without resulting in binding of the linkage or an undesirable arm and shoulder motion. Accordingly, existing elliptical exercise devices have not incorporated an adjustable ramp or guide with structure for arm, shoulder and upper body motion.

Another drawback to these linked devices lies in the desire of certain users to utilize the foot motions without a corresponding utilization of the arm apparatuses. Because the arm apparatuses travel through a given path regardless of whether the user is exerting any force on the arm apparatus, many users find the back and forth motion of the arm apparatuses to be bothersome and distracting when the user does not wish to engage the arm apparatuses.

What would thus be desirable is an exercise device that provides for smooth natural action, and exercises a relatively large number of muscles through a large range of motion. It would be further desirable for an exercise device to employ a natural, desirable arm, shoulder, and upper body movement in association with the ability to enable the user to vary the step height, or the angle of the elliptical path that the feet traveled relative to horizontal, of the exercise device. It would be further desirable for an exercise device to further allow a user to easily and efficiently choose to use or not to use the arm apparatus.

SUMMARY OF THE INVENTION

The present invention provides an elliptical exercise device including a frame having a pivot axis, a foot link, a coupling, a swing arm, an engagement mechanism, and a guide system. The foot link has a rearward portion, a forward portion, and a foot support portion. The foot support portion has a central location. The coupling is associated with the rearward portion of the foot link for coupling the rearward portion of the foot link to the pivot axis so that the rearward portion of each foot link travels in a closed path relative to the pivot axis. The engagement mechanism has a first portion coupled to the swing arm and a second portion coupled to the foot link at a location rearward of the central location of the foot support portion, such that a force applied to the swing arm will produce a force on the foot link. The guide system supports the forward portion of the foot link along a preselected reciprocating path of travel as the rearward portion of the foot link travels along its path of travel. The guide system is selectably positionable in a plurality of different positions, such that when the exercise device is in use the foot support portion moves along a generally elliptical path of travel.

According to a principal aspect of a preferred form of the invention, an elliptical exercise device includes a frame, first and second foot links, first and second foot supporting portions, a coupling, a guide, first and second swing arms, and first and second engagement mechanisms. The frame has a pivot axis defined thereon. The frame is configured to be supported on a floor. Each of the first and second foot links includes a first portion and second portion. The first and second foot supporting portions are configured for receiving the feet of the user, and are supported by the first and second foot links, respectively. Each of the first and second foot supporting portions includes a central location. The coupling is associated with the first portion of each foot link for coupling the first portion of each foot link to the pivot axis so that the first portion of each foot link travels in a closed path relative to the pivot axis. The guide is associated with the frame and operative to engage and direct the second portions of the foot links along preselected reciprocating paths of travel as the first portions of the respective foot links travel along their paths of travel, so that when the exercise device is in use the foot support portion moves along a generally elliptical path of travel. The first and second swing arms each have a central portion pivotally coupled to the frame, and a lower portion. The first and second engagement mechanisms are coupled to the lower portion of the first and second swing arms, respectively. The first and second engagement mechanisms are further coupled to the first and second foot links, respectively, at a location rearward of the central location of the first and second foot support portions, respectively.

According to another preferred aspect of the invention, an exercise device includes a frame having a pivot axis, a foot link, a coupling, a swing arm, an arm enabling/disabling mechanism, and a selectably positionable guide system. The foot link has a rearward portion, a forward portion, and a foot support portion. The coupling is associated with the rearward portion of the foot link for coupling the rearward portion of the foot link to the pivot axis so that the rearward portion of the foot link is constrained to move in an orbital path. The swing arm has a pivotal connection to the frame. The arm enabling/disabling mechanism is operatively engaged with the swing arm, and includes an engaged position in which the swing arm is coupled to the foot link by the engagement mechanism. The arm enabling/disabling mechanism also includes a disengaged position in which at least a portion of the swing arm is disengaged from the foot link. The guide system supports the forward portion of the foot links along a preselected reciprocating path of travel as the rearward portion of the respective foot links travel along their paths of travel, such that when the exercise device is in use the foot support portion moves along a generally elliptical path of travel.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein:

FIG. 5 illustrates a close-up perspective view of the front of the exercise device of FIG. 1.

FIG. 6 illustrates a front, elevated view of an arm enabling/disabling mechanism.

DETAILED DESCRIPTION OF THE INVENTION

While an exemplary embodiment of the invention has been illustrated and described, it will be appreciated that various changes can be made therein without departing from the spirit and scope of the invention.

Figure 2A:
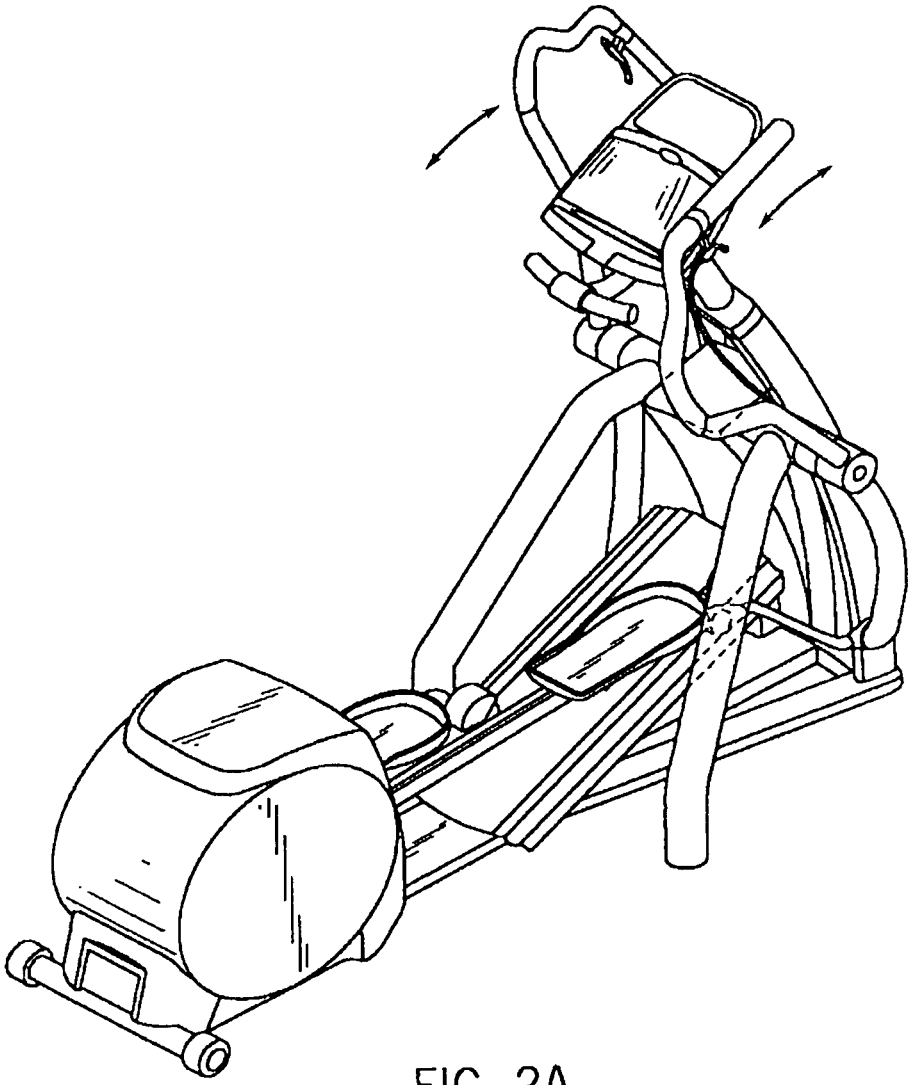
FIG. 2A (PRIOR ART)
FIGS. 2*a* and 2*b* show two prior art exercise devices.

As previously described, a class of elliptical devices of the prior art was capable of providing both arm and shoulder motions as well as elliptical foot motions. An example of such a prior art device is seen in FIG. 2A. Such devices generally include left and right swing arm mechanisms that are connected to left and right foot links at the uppermost periphery of the foot links in order to link arm and shoulder motions to foot motions. However, a significant drawback of this class of elliptical trainers is that the height or angle from horizontal of the elliptical path that the feet traveled was fixed.

Figure 2B:
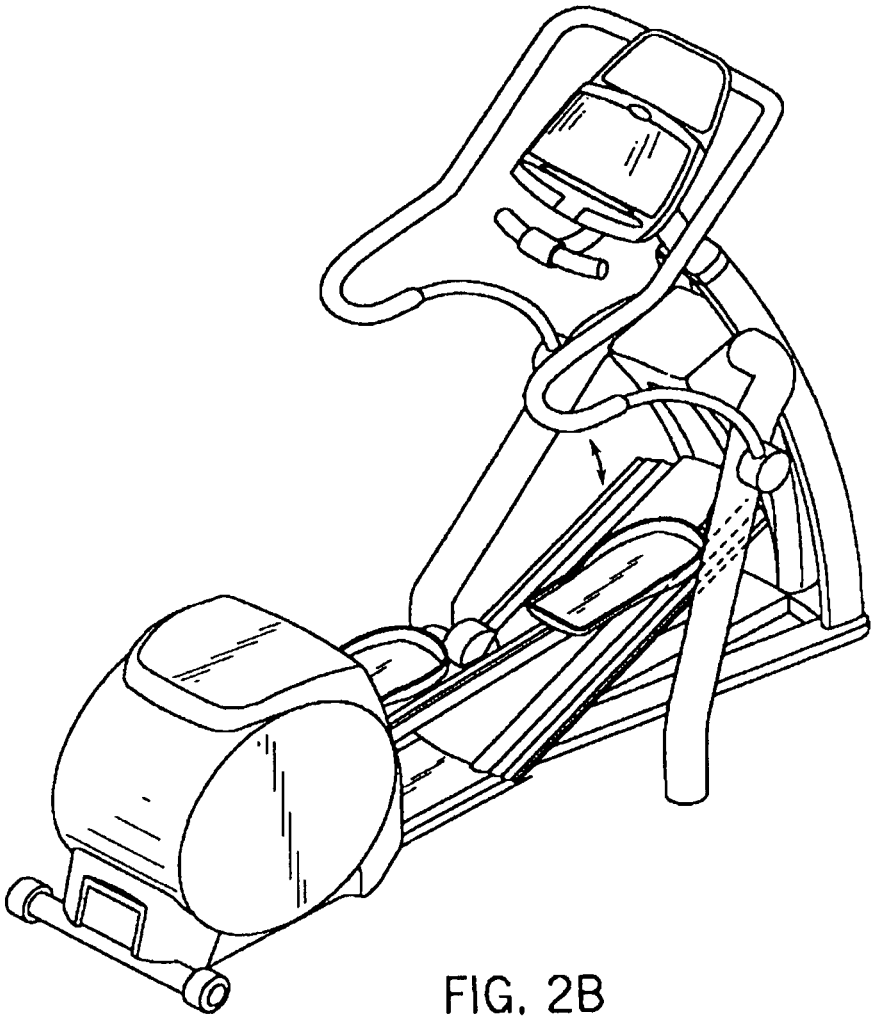
FIG. 2B (PRIOR ART)

Another class of elliptical devices was capable of providing such adjustable guide with which the user could adjust the angle of the elliptical path that the feet traveled relative to horizontal by raising or lowering guide tracks. An example of such a prior art device is seen in FIG. 2B. Because of the complexity and geometry of the linkage connecting the arm, shoulder and upper body motion with the foot motion, and the configuration of the components used to provide the adjustable guide, existing elliptical exercise devices have not combined upper body motion with an adjustable guide.

In accordance with the principles of the present invention, an exercise device 10 is provided that exercises both the upper and lower body in associated motion while providing user selectable generally elliptical motions at various angles from horizontal. Briefly described, the exercise device 10 includes a frame 12 that has a forward upright member 20. The frame 12 is configured to be supported on a floor or generally horizontal surface. The forward upright member 20 extends upwardly and can curve slightly rearwardly from a substantially horizontal, longitudinal central member 14 of the frame 12. Left and right axle mounts 30, 32 (seen in FIG. 4) extend upwardly towards the rear region of the frame 12. The axle mounts 30, 32 support a transverse axle 34 that is preferably operatively connected to a flywheel 36. The left and right ends of the transverse axle 34 rotatably engage left and right crank arm assemblies 40, 50. Left and right foot links 60, 70 each include a forward portion 62, 72; a rearward portion 64, 74; and a foot support portion 66, 76 therebetween. The rearward portions 64, 74 of the foot links 60, 70 engage the crank arm assemblies 40, 50 such that the foot support portion 66, 76 of the foot links travel in a generally elliptical path as the transverse axle 34 rotates.

The forward portions 62, 72 of the foot links 60, 70 preferably are supported by rollers 68, 78, which engage guide tracks 42, 52 that are mounted to the frame 12. The exercise device 10 includes an adjustable guide 118 with which the user can adjust the angle of the elliptical path that the feet traveled relative to horizontal. Referring to FIG. 6, a front, elevated view of the adjustable guide. The adjustable guide comprises a motor 119 which is connected to a lead screw 121 by a suitable mechanism such as gears in a gear housing 128. A follow thread 124 is carried on the upper ends of the guide tracks 42, 52. The lower ends of the guide tracks 42, 52 are secured to the frame 12 by a hinged or pivotal mounting. The follower thread 124 rides up and down the lead screw 120 for selectively adjusting the angle of inclination of the guide tracks 42, 52.

Referring back to FIG. 1, the foot links 60, 70 are operatively connected to engagement assemblies 100; 110, which in turn are operatively connected to the coupling regions 86, 96 of left and right swing arm mechanisms 80, 90, respectively. The swing arm mechanisms 80, 90 are rotatably connected to the forward upright member 20 of the frame 12 at their respective pivot points 84, 94. The swing arm mechanisms 80, 90 further contain left and right hand-gripping portions 82, 92. Each engagement assembly 100, 110 includes an extended arm 106, 116 connected between the coupling regions 86, 96 of left and right swing arm mechanisms 80, 90 and the foot links 60, 70.

More particularly, the frame 12 includes the longitudinal central member 14 that terminates at forward and rearward portions 16, 18. Preferably, the forward portion 16 of the frame 12 simply terminates at the end of the longitudinal central member 14, while the rearward portion 18 terminates as a relatively shorter transverse member. Ideally, but not essentially, the frame 12 is composed of tubular members that are relatively light in weight but that provide substantial strength and rigidity. The frame 12 may also be composed of solid members that provide the requisite strength and rigidity while maintaining a relatively lightweight.

The forward upright member 20 extends upwardly from the forward portion 16 of the floor-engaging frame 12: Preferably, the upright member 20 is slightly rearwardly curved; however, the forward member 20 may be configured at other upward angles without departing from the scope of the present invention. A relatively short, transversely oriented crossbar member 22 is connected to the forward upright member 20. Left and right balance arms 24, 26 can depend downwardly from each end of the crossbar member 22 to engage the floor on each side of the longitudinal central member 14 near the forward portion of the exercise device 10, thereby increasing stability. Ideally, but not essentially, these members are composed of a material similar to that described above, and are formed in quasi-circular tubular configurations.

Preferably, a view screen 28 can be securely connected to the upper portion of the forward upright member 20; at an orientation that is easily viewable to a user of the exercise device 10. Instructions for operating the device as well as courses being traveled may be located on the view screen 28 in an exemplary embodiment. In some embodiments of the present invention, electronic devices may be incorporated into the exercise device 10 such as timers, odometers, speedometers, heart rate indicators, energy expenditure recorders, controllers, etc. This information may be routed to the view screen 28 for ease of viewing for a user of the exercise device 10.

Figure 4:
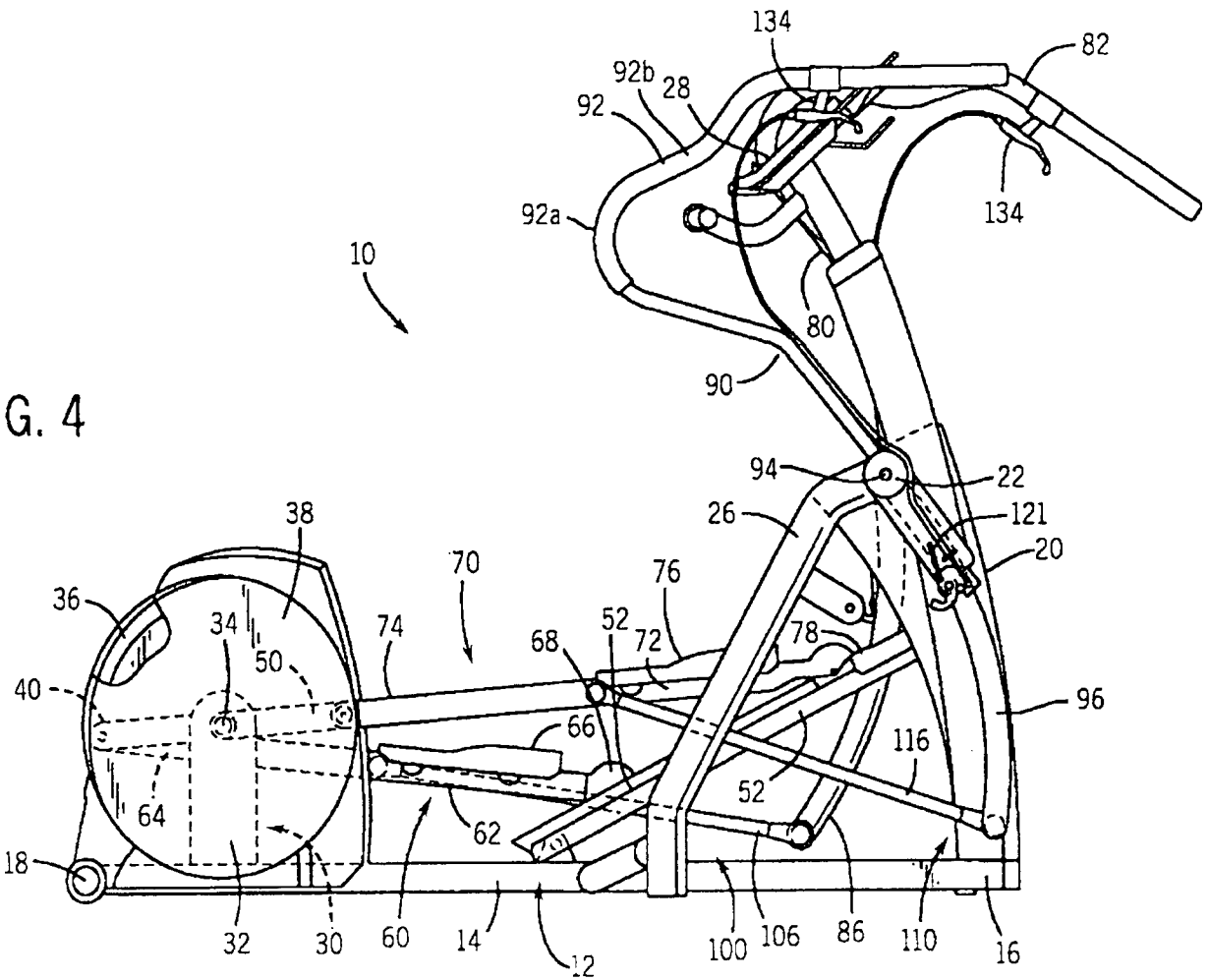
FIG. 4 illustrates a side, elevated view of the exercise device of FIG. 1.
Figure 7:
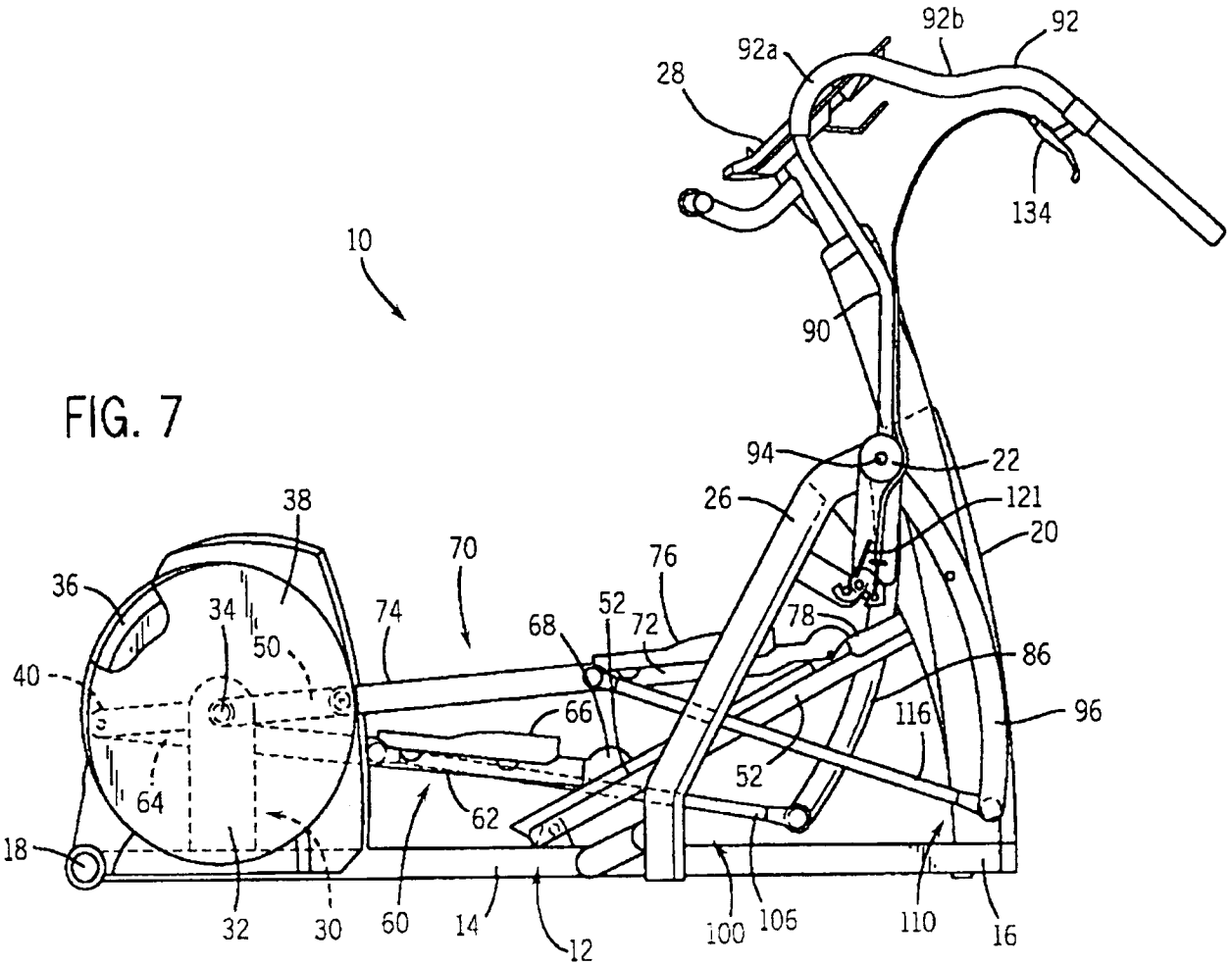
FIG. 7 illustrates a side, elevated view of the exercise device of FIG. 1 with the swing arm assemblies in a different position than FIG. 4.

In the exemplary embodiment shown in FIGS. 4 and 7, the axle mounts 30, 32 are located toward the rearward portion 18 of the frame 12. The axle mounts 30, 32 are attached to the frame 12 and extend approximately upward from the substantially horizontal, longitudinal central member 14. The transverse axle 34 is rotatably housed in the upper region of the axle mounts 30, 32. These regions of the axle mounts 30, 32, which house the ends of the transverse axle 34, contain low friction engaging systems (not shown) such as bearing systems, to allow the transverse axle 34 to rotate with little resistance within the housing in the axle mounts 30, 32.

Referring again to the exemplary embodiment shown in FIGS. 4 and 7, the transverse axle 34 connects to a flywheel 36 contained within a center housing 38. Such flywheels are known in the art. However, in other embodiments, the transverse axle 34 may not incorporate a flywheel 36 and/or central housing 38, without departing from the scope of the present invention (provided that the foot links 60, 70 are coupled to one another in some fashion, albeit directly or indirectly). In other embodiments, one or more flywheels may be operably coupled to the transverse axle though belts or gears. The transverse axle 34 may also be operatively connected to a capstan-type drive (not shown) in some embodiments, to allow the axle 34 to rotate in only one direction.

Figure 8:
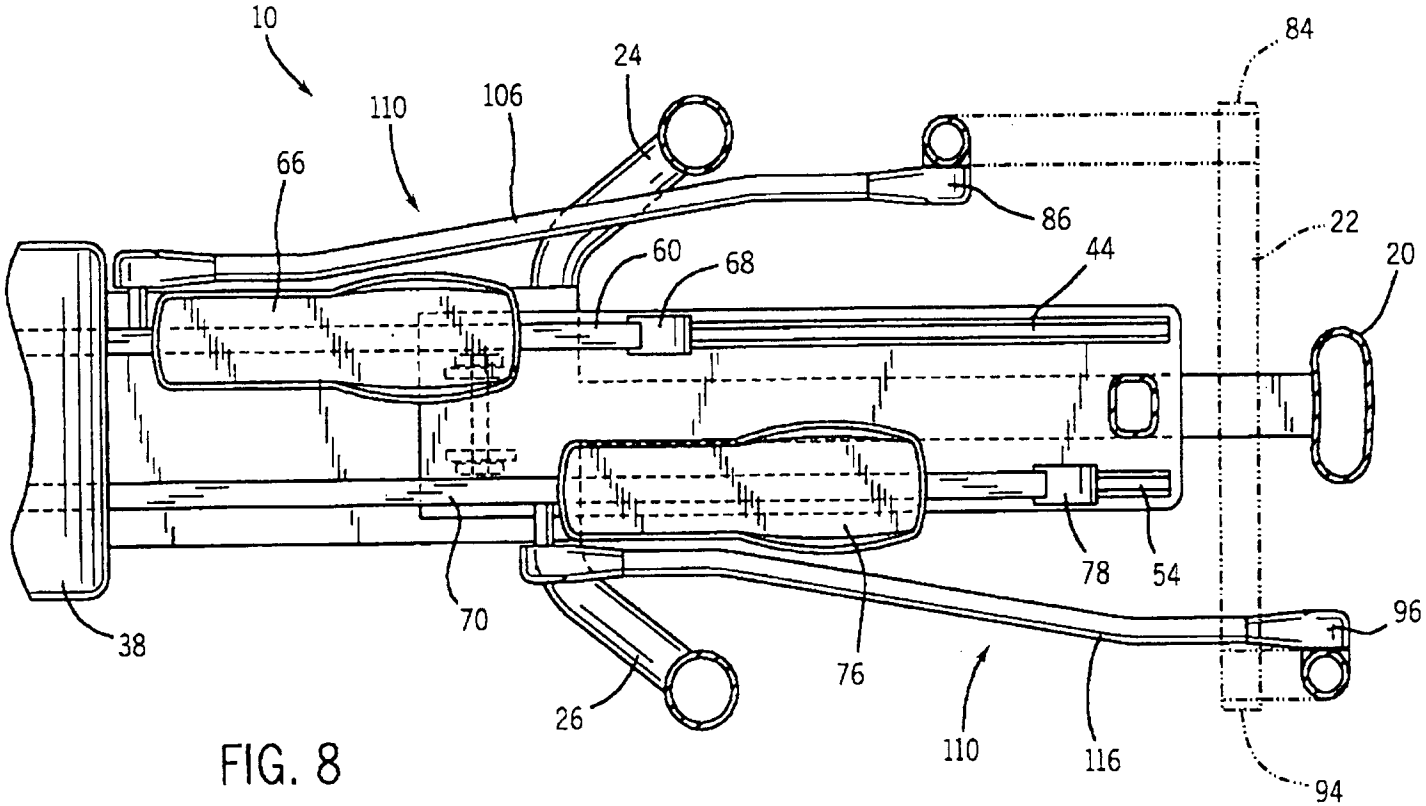
FIG. 8 illustrates a close-up perspective view of a portion of the exercise device of FIG. 1.
Figure 9:
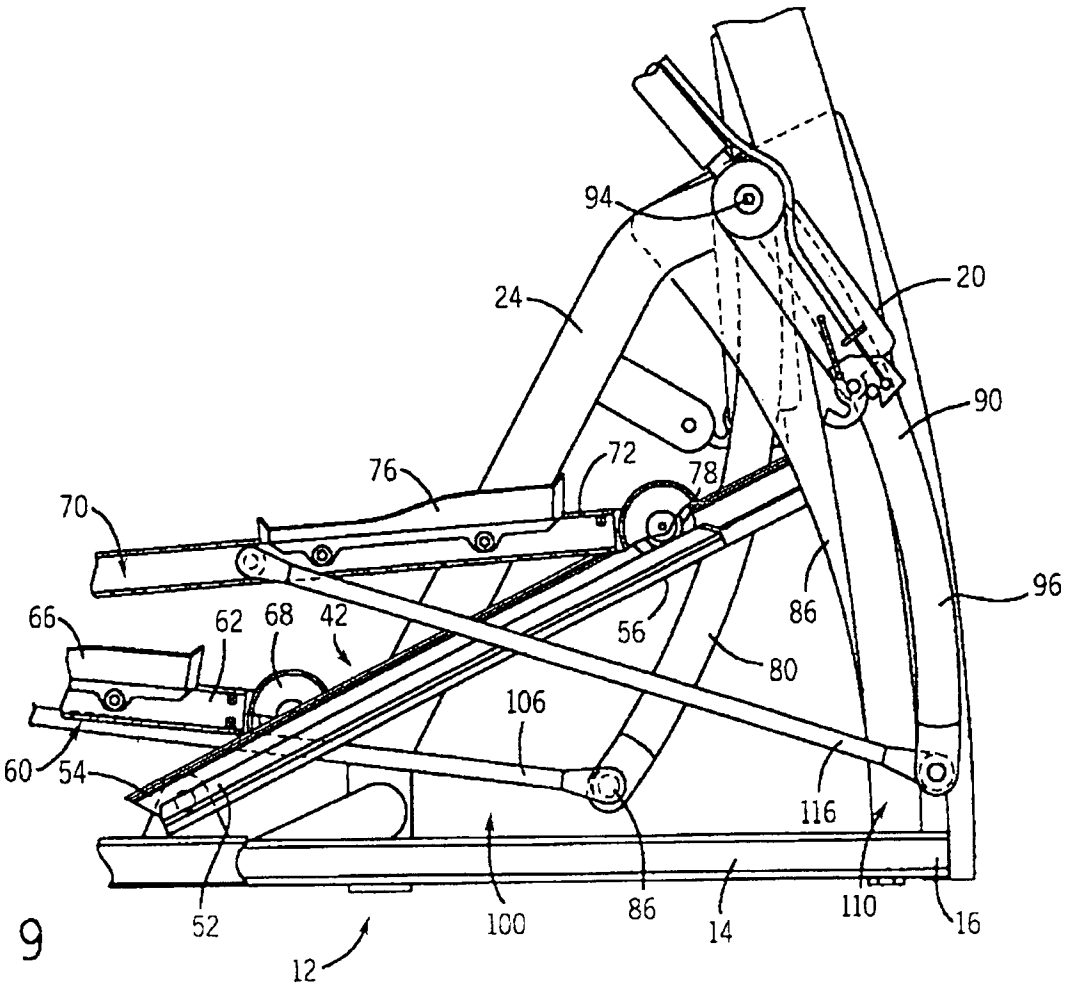
FIG. 9 illustrates a close-up side view of the exercise device of FIG. 1.
Figure 10:
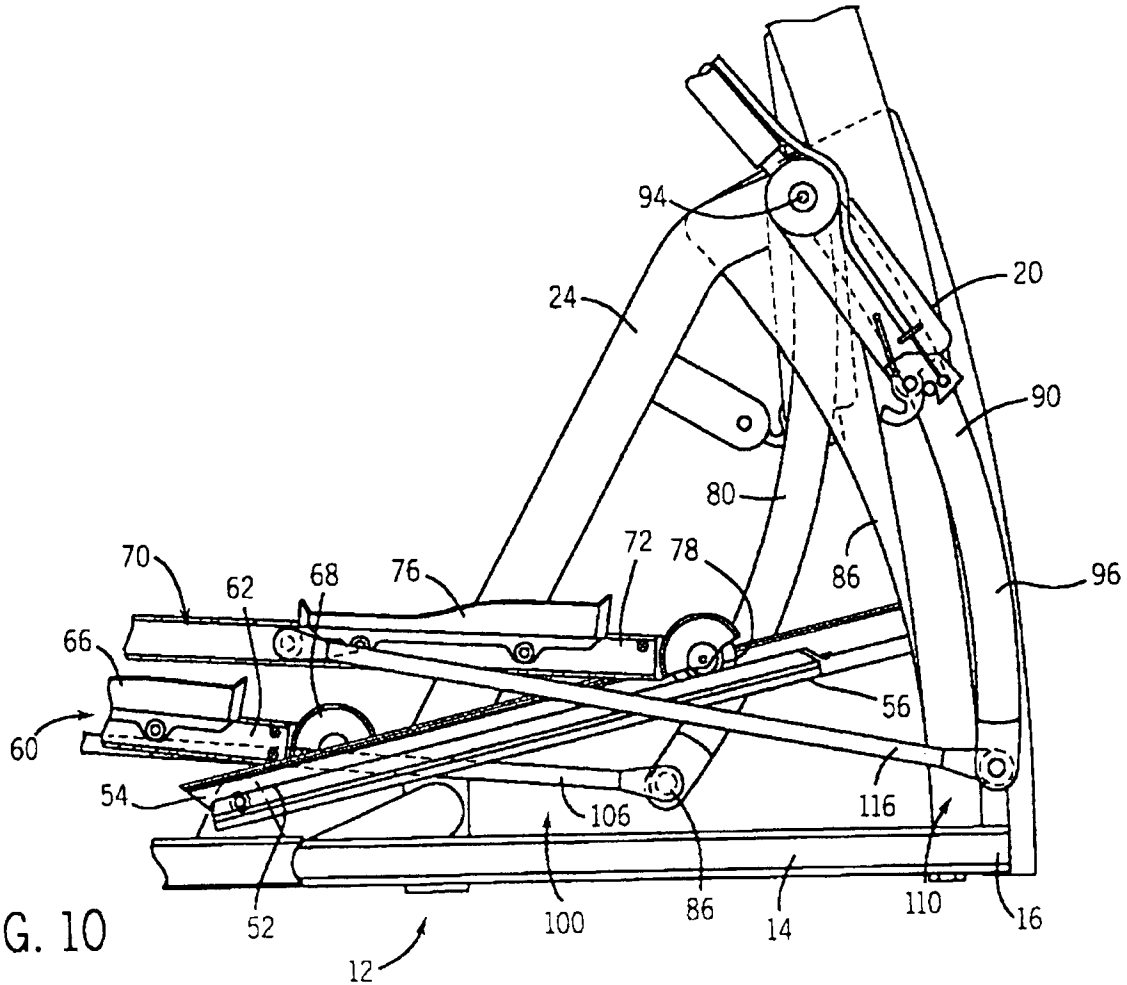
FIG. 10 illustrates a close-up side view of the exercise device of FIG. 1 with the guide tracks in a different position than FIG. 8.

The exercise device 10 further contains longitudinally extending left and right foot links 60, 70. As shown in FIG. 8, the foot links 60, 70 are illustrated in the shape of elongated, relatively thin beams. The foot links 60, 70 are aligned in approximately parallel relationship with the longitudinal central member 14 of the frame 12. The foot support portions 66, 76 are positioned near the forward portion of the foot links 60, 70, and provide stable foot placement locations for the user of the device. In some exemplary embodiments the foot support portions 66, 76 are configured to form toe straps and/or toe and heel cups (not shown) which aid in forward motion recovery at the end of a rearward or forward striding motion of a user's foot. Each foot support portion 66, 76 has a central location centrally positioned between the forwardmost and rearwardmost ends of the foot support portion 66, 76.

Referring back to FIGS. 4 and 7, left and right crank arm assemblies 40, 50 couple the rearward portions 64, 74 of the foot links 60, 70 to the ends of the transverse axle 34. In one embodiment of the present invention, the crank arm assemblies 40, 50 are comprised of single left and right crank arm members. In this exemplary embodiment the proximal portions of the crank arm members 40, 50 engage the ends of the transverse axle 34, while the distal portions of the crank arm members 40, 50 are rotatably connected to the rearward portions 64, 74 of the foot links 60, 70. In this configuration, the rearward portions 64, 74 of the foot links 60, 70 orbit about the transverse axle 34 as the axle rotates, and the foot support portions 66, 76 of the foot links 60, 70 travel in a reciprocal, elliptical path of motion; however, the elliptical path of the foot support portions 66, 76; indeed, the motion of the entire foot links 60, 70 can be altered into any number of configurations by changing the composition or dimensions of the crank arm assemblies 40, 50. For example, the length of the single left and right crank arms shown in FIGS. 4 and 7 can be lengthened or shortened to modify the path of the foot links 60, 70. Further, the left and right crank arm assemblies 40, 50 can be composed of multiple crank arm member linkages to alter the path of travel of the foot links 60, 70 in a wide variety of aspects.

In an alternate embodiment of the present invention, the rearward portions 64, 74 of the foot links 60, 70 are rotationally connected directly to a flywheel which functions to couple the foot links 60, 70 to a pivot axis (equivalent to the axis of the transverse axle 34) and permit rotation thereabout. In this embodiment, the flywheel is preferably a double flywheel that supports rotation about a central axis. Various mechanical arrangements may be employed to embody the crank arm assemblies 40, 50 in operatively connecting the foot links 60, 70 to each other. Such variations may include a larger flywheel, a smaller flywheel, or may eliminate the flywheel entirely and incorporate a cam system with connecting linkage, provided that the foot links are coupled so as to permit a generally elliptical path of travel by the foot support portions 66, 76 of the foot links 60, 70.

As most clearly shown in FIGS. 5, 6, 9, and 10, the exercise device 10 further contains left and right guide tracks 42, 52 which engage the rollers 68, 78 supporting the forward portions 62, 72 of the foot links 60, 70. Preferably, the upper surface of the guide tracks 42, 52 can be shaped to contain two longitudinally extending, adjacent engagement grooves 44, 54. These engagement grooves 44, 54 give the upper surface of the guide tracks 42, 52 a generally "W-shaped" cross-sectional configuration best seen in FIG. 6. The engagement grooves 44, 54 are specifically sized and shaped to correspondingly mate with the rollers 68, 78 of the foot links 60, 70 in order to assist in the lateral containment of the rollers 68, 78 on the guide tracks.

The guide tracks 42, 52 attach to the longitudinal central member 14 of the frame 12 via the adjustable guide 118 with which the user can adjust the angle of the elliptical path that the feet traveled relative to horizontal. Thus, in FIG. 9 the guide tracks 42, 52 are seen at an angle relative to horizontal greater than the angle relative to horizontal of the guide tracks 42, 52 seen in FIG. 10, wherein the guide tracks have been lowered via the adjustable guide 118. In one embodiment, the guide tracks 42, 52 can be adjusted at an angle from horizontal within the range of about zero degree (0°) to about a forty degree (40°) angle from horizontal, which results in an angle of the major axis of the ellipse being about five degrees (5°)to about thirty degrees (30°).

The left and right forward portions 62, 72 of the foot links 60, 70 terminate in left and right engagement rollers 68, 78. The left and right engagement rollers 68, 78 ride along the above-described grooves 44, 54 of the guide tracks 42, 52. Preferably, the engagement rollers 68, 78 are actually pairs of rollers. The engagement rollers 68, 78 rotate about axles that are coupled to the forward portions 62, 72 of the foot links 60, 70. During use of the exercise device 10, the engagement rollers 68, 78 at the front of the foot links 60, 70 translate back and forth the length of the guide tracks 42, 52 in rolling engagement within the grooves 44, 54, as the foot support portions 66, 76 of the foot links 60, 70 travel in a generally elliptical path of motion, and the rearward portions 64, 74 of the foot links 60, 70 generally rotate about the transverse axle 34. In an alternate embodiment of the present invention, the engagement rollers 68, 78 could be replaced with other forms of sliding, rolling or translation engagement mechanisms without departing from the scope of the present invention.

As previously described, one drawback to prior art devices where arm and shoulder motions are linked to foot motions is that, because of the complexity of the mechanism used to provide an adjustable guide with which the user could adjust the angle of the elliptical path that the feet traveled relative to horizontal, such adjustable elliptical devices have not incorporated arm and shoulder motions thus failing to provide total body cross training. An exercise device in accordance with the principles of the present invention overcomes this drawback by the use of an inventive coupling of the foot links 60, 70 to the left and right swing arm mechanisms 80, 90.

Referring to FIGS. 4, 5 and 8, the foot links 60, 70 are operatively connected to engagement assemblies 100, 110, which in turn are operatively connected to the coupling regions 86, 96 of left and right swing arm mechanisms 80, 90, respectively. Each engagement assembly 100, 110 includes an extended arm 106, 116 pivotally connected to the coupling regions 86, 96 of left and right swing arm mechanisms 80, 90. At the end opposite the connection with the coupling regions 86, 96, the extended arms 106, 116 are pivotally connected to the foot links 60, 70. The pivotal connection of the extended arms 106, 116 with the foot links 60, 70 is advantageously located at a position rearward of the central position of the foot support portions 66, 76. In a preferred embodiment, the pivotal connection of the extended arms 106, 116 to the foot links 60, 70 is positioned at or near a rearwardmost end of the foot support portions 66, 76. The terms "rear" and "rearward" refer to a position, location or direction toward the transverse axle 34. By positioning the pivotal connection of the extended arms 106, 116 to the foot links 60, 70 at a position rearward of the central location of the foot support portions 66, 76, the extended arms 106, 116 do not bind, or otherwise inhibit, the motion of the coupling regions 86, 96 of the left and right swing arm mechanisms 80, 90, in any of the available guide track 42, 52 positions provided by the adjustable guide 118. Accordingly, the reciprocating motion of each swing arm mechanism 80, 90 about pivot points 84, 94 is unaffected by the position of the guide tracks 42, 52 and the extending arms 106, 116. In addition, the extended arms 106, 116 are preferably shaped to provide a generally close profile to the foot support portions 66, 76 so as not to interfere with the movement of the foot support portions 66, 76 or with the user mounting the exercise device 10. The pivotal connection of the extended arms 106, 116 to the foot support portions 66, 76 enables the guide tracks 42, 52 to be repositioned in any position by the adjustable guide 118 while maintaining the full benefit of the upper body motion. Accordingly, the motion of the left and right swing arm mechanisms 80, 90, including the left and right hand-gripping portions 82, 92, remains generally unchanged as the position of the guide tracks 42, 52 are adjusted. The engagement assemblies 100, 110 allow for such full upper body motion through all the available ramp or guide positions of the adjustable guide 118 without binding and without resulting in undesirable alterations to the upper body motion of the swings arm mechanisms 80, 90.

Referring again to FIG. 1, the coupling regions 86, 96 of the swing arm mechanisms 80, 90 rotatably connect to the engagement assemblies 100, 110, and in turn to the foot support portions 66, 76 of the foot links 60, 70. The pivot points 84, 94 rotatably secure the swing arm mechanisms 80, 90 to each end of the crossbar member 22 of the frame 12.

The hand-gripping portions 82, 92 of the swing arm mechanisms 80, 90 are grasped by the hands of the individual user, and allow upper body arm and shoulder exercising motions to be incorporated in conjunction with the reciprocal, elliptical exercising motion traced out by the user's feet. The linking of the swing arm mechanisms 80, 90 to the foot links 60, 70, via the engagement assemblies 100, 110, and the rotational securement of the swing arm mechanisms 80, 90 to the forward upright member 20 of the frame 12 at the pivot points 84, 94, results in generally rearward, arcuate motion of a hand-gripping portion being correspondingly linked to a generally forward, arcuate or elliptical motion of a respective foot support portion, and vice versa.

Figure 11:
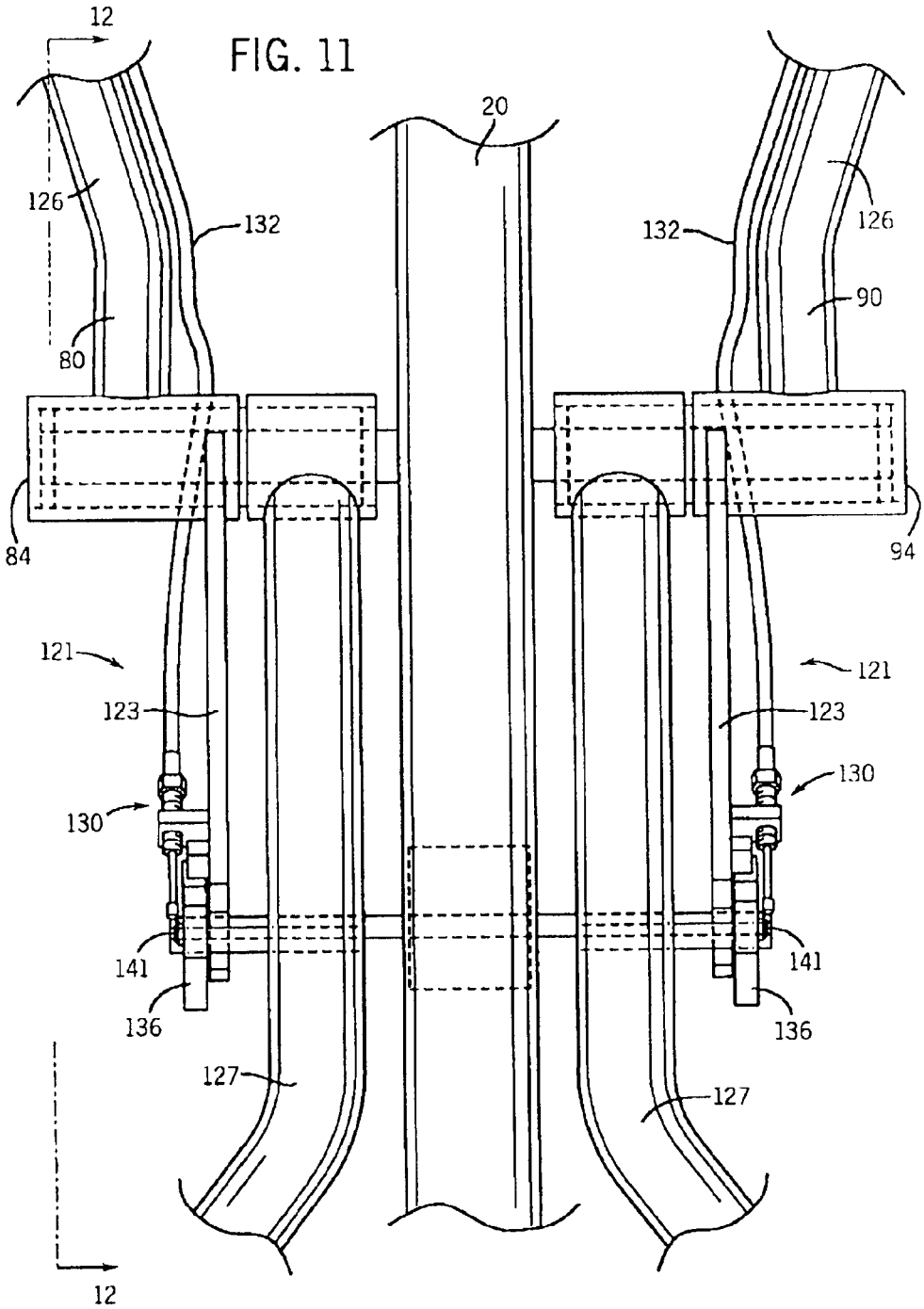
FIG. 11 is a front, elevated view of an arm enabling/disabling mechanism.
Figure 12:
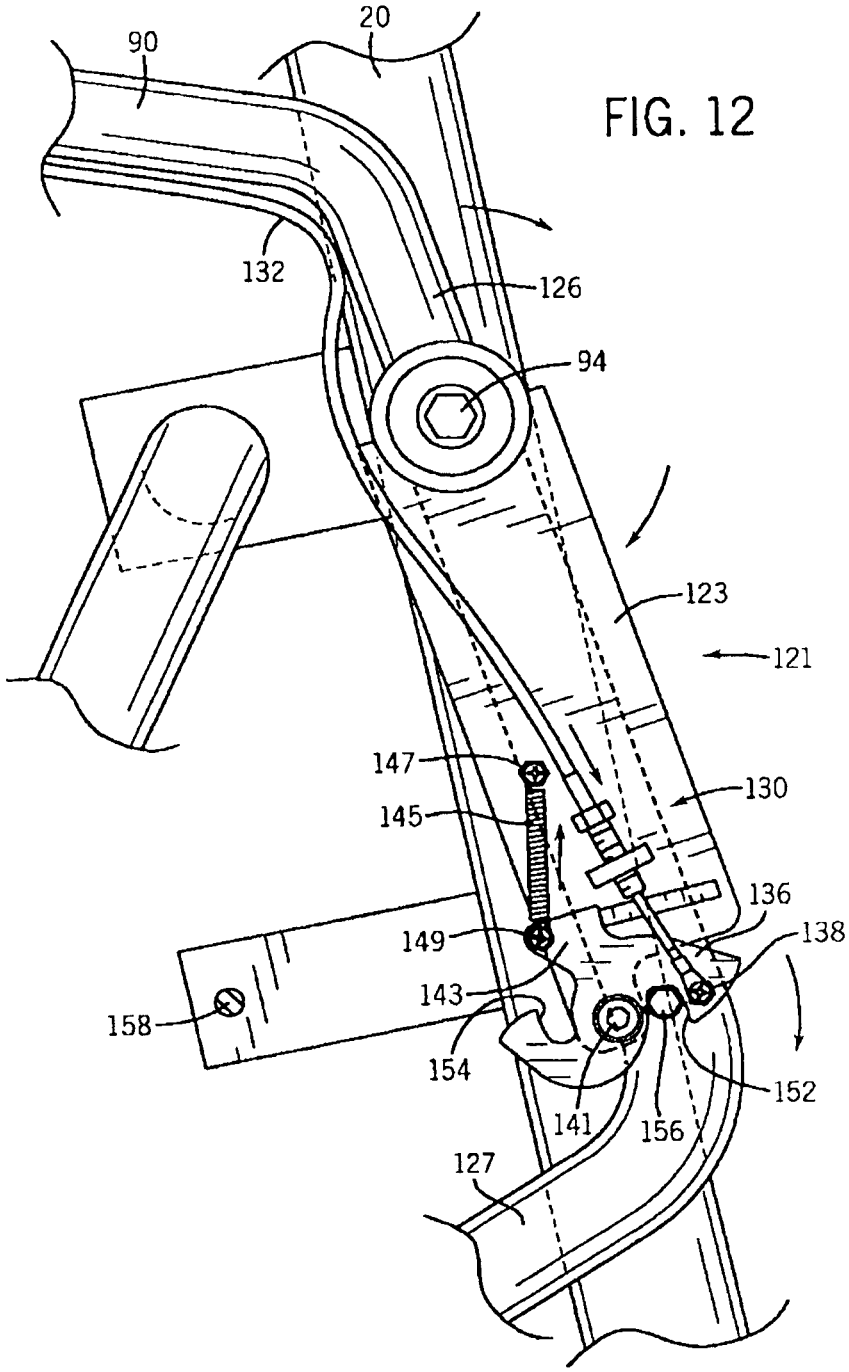
FIG. 12 is a close-up side view of the arm enabling/disabling mechanism of FIG. 11.
Figure 13:
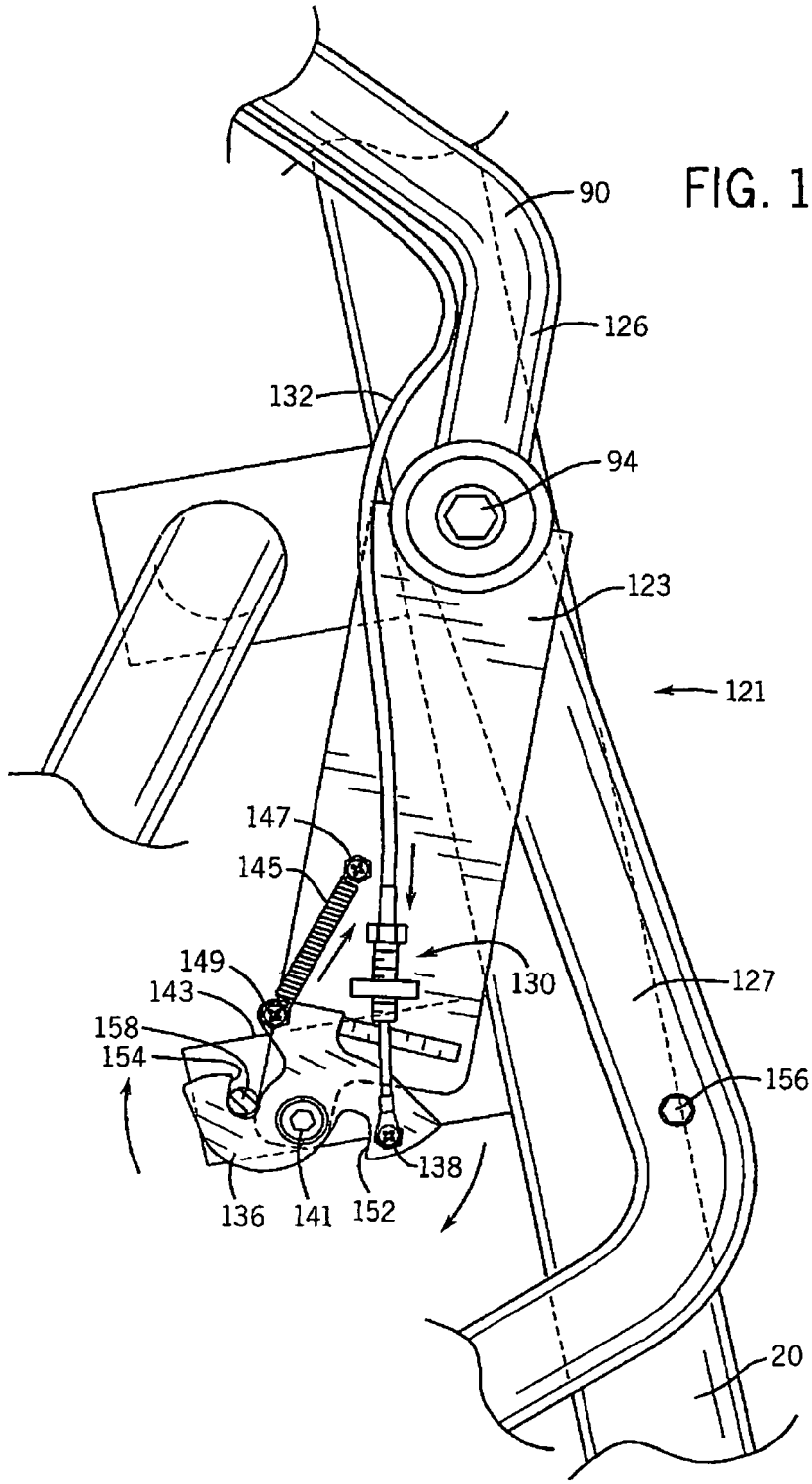
FIG. 13 is a close-up side view of the enabling/disabling mechanism of FIG. 10 with the arm mechanisms in between the enable and disabled positions.

In one embodiment, the hand-gripping portions 82, 92 of the swing arm mechanisms 80, 90 can be either enabled or disabled by the user. Referring to FIGS. 11-13, an arm enabling/disabling mechanism 121 is seen. FIG. 11 is a front, elevated view of the arm enabling/disabling mechanism 121 of the present invention. FIGS. 12 and 13 are close-up side views of the arm enabling/disabling mechanism 121 of the present invention. For ease of reference, only a single arm enabling/disabling mechanism 121 contained on one side of the pivot point connection 84, 94 will be described.

A bracket 123 is securely connected to the arm mechanism and extends downwardly on each side of the pivot point connection 84, 94. The bracket 123 provides a pivotal connection 94 between an upper portion 126 and a lower portion 127 of the swing arm mechanism 90. While this exemplary arm enabling/disabling mechanism 121 is shown and described as positioned connected to the arm mechanism at the approximate midpoint of the arm mechanism, it should be appreciated that the position of the arm enabling/disabling mechanism is not critical to the principles of the present invention so long as the positioning of the arm enabling/disabling mechanism allows the arm mechanisms to be disengaged from the leg portion.

Figure 1:
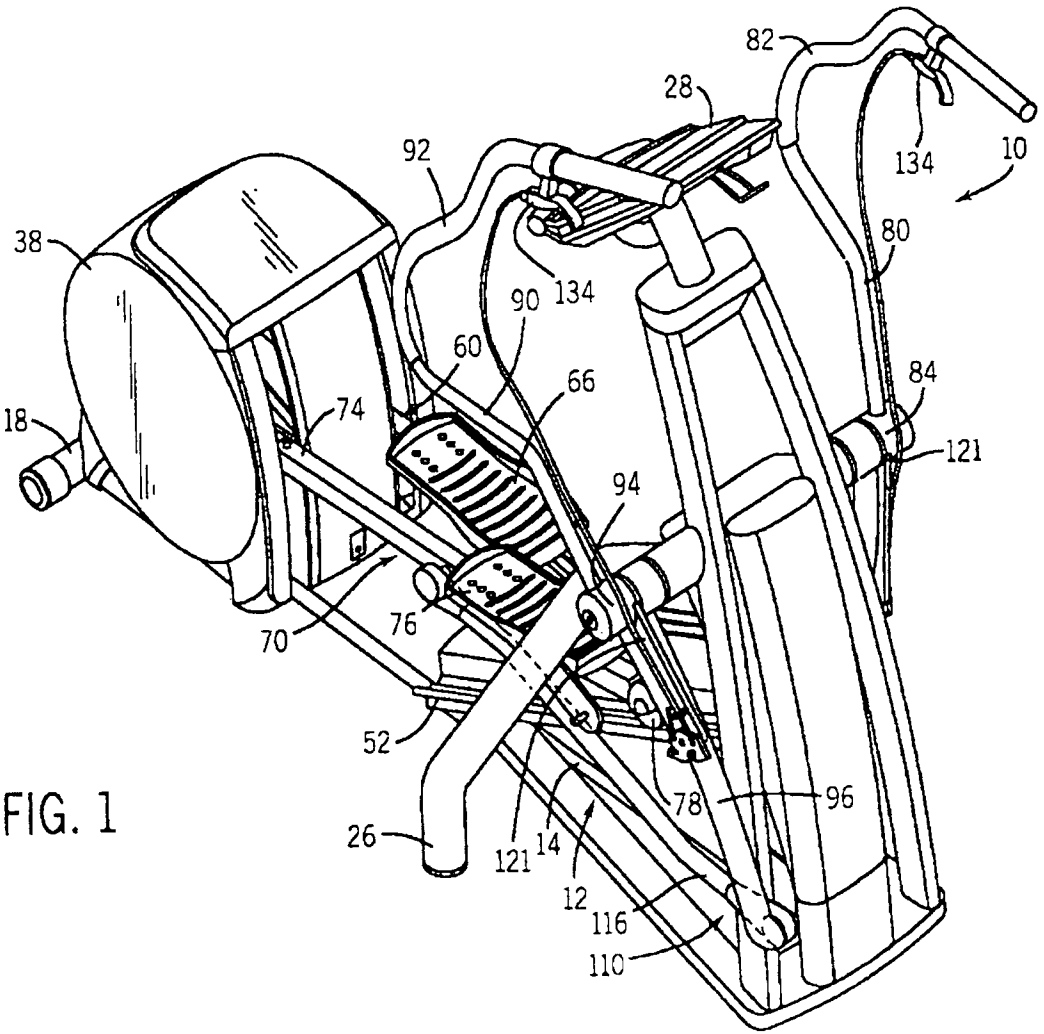
FIG. 1 illustrates an elevated front perspective view of an exercise device in accordance with the principles of the present invention.
Figure 3:
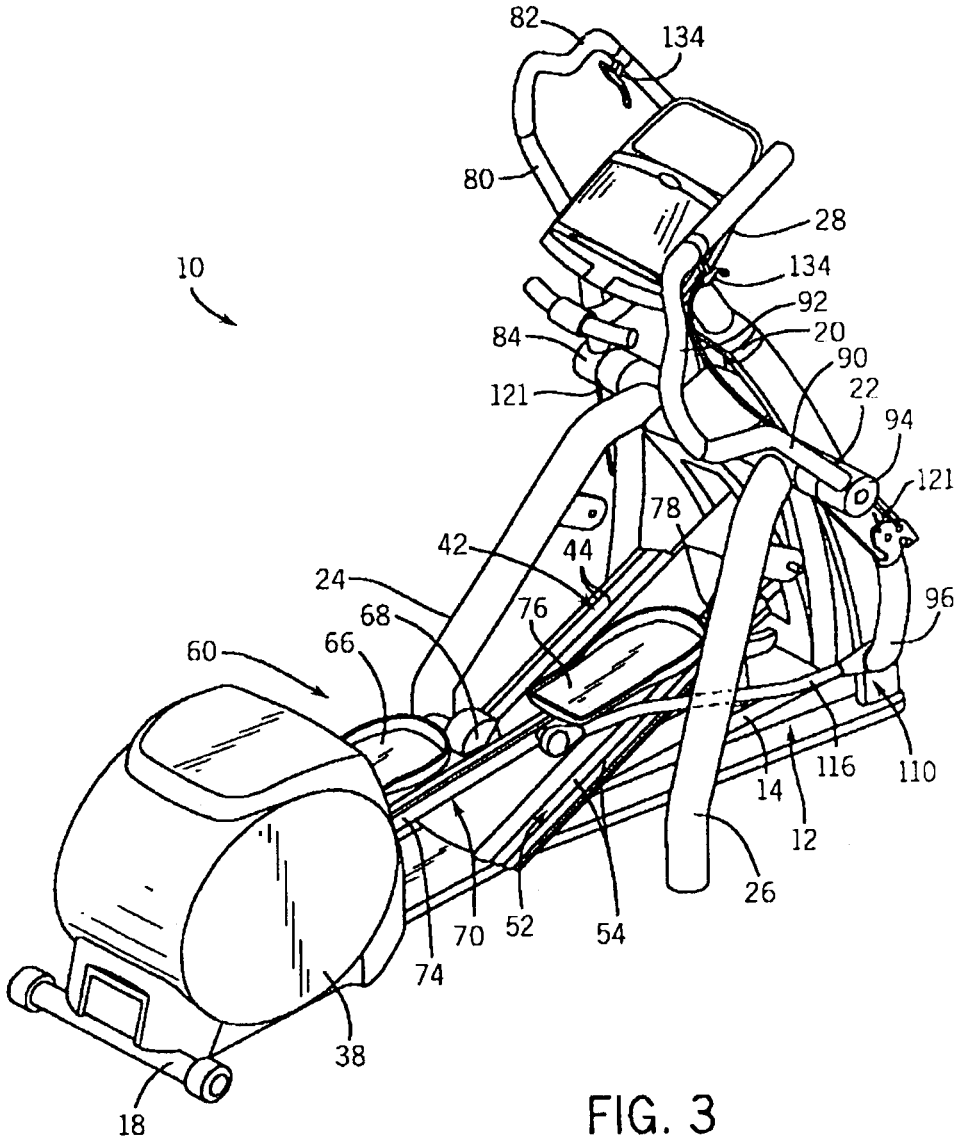
FIG. 3 illustrates an elevated rear perspective view of the exercise device of FIG. 1.

The bracket 123 secures a cable assembly 130 having a cable 132 connected at one end to an actuator 134 contained on the arm mechanism 90 proximal to the hand-gripping portions 92 (seen in FIG. 1). In one embodiment, the actuator 134 is a hand lever as depicted in FIGS. 1-3; in additional embodiments, alternative actuators such as but not limited to push rods, push buttons, rotary hand member, etc. can be utilized. The opposite end of the cable 132 is connected to a latching plate 136 by a suitable securing apparatus 138. The latching plate 136 is pivotally secured to the bracket 123 around a latching plate pivot axis 141. The latching plate 136 includes a biasing arm 143 having a biasing member 145 such as a spring connecting the biasing arm 143 to the bracket 123 by suitable securing apparatus 147, 149. Thus, the latching plate 136 is biased around the latching plate pivot axis 141 in opposition to the cable 132, thereby providing biasing resistance to the cable 132.

The latching plate 136 further defines two slots 152, 154. The first slot 152 secures the arm enabling/disabling mechanism 121 in the enabled position; the second slot 154 secures the arm enabling/disabling mechanism 121 in the disabled position. Proximal to the latching plate 136 in the enabled position an outwardly extending enable pin 156 extends from the lower portion 127 of the swing arm mechanism 90. The outwardly extending enable pin 156 is adapted to coordinate with the first slot 152 defined in the latching plate 136. The biasing member 145 biases the latching plate 136 such that the outwardly extending enable pin 156 is securely engaged in the first slot 152.

FIG. 12 is a close-up view of the enabling/disabling mechanism of FIG. 11 with the swing arm mechanism 90 in the enable position; FIG. 13 is a close-up view of the enabling/disabling mechanism of FIG. 11 with the swing arm mechanism 90 in the disabled position. Proximal to the latching plate 136 in the disabled position, an outwardly extending disable pin 158 extends from the exercise device. When the hand-gripping portion 92 of the swing arm mechanism 90 has been extended forward with the actuator 134 activated, the latching plate 136 extends rearward and receives the outwardly extending disable pin 158 in the second slot 154. Once the second slot 154 receives the disable pin 158, the actuator 134 can be released to cause the disable pin 158 to be releasably secured in the second slot 154. The latching plate 136 biasing member 145 biases latching plate 136 against the outwardly extending disable pin 158 to secure the swing arm mechanism 80 in the disabled position. In a further embodiment, a locking mechanism could be employed to further secure the outwardly extending enable pins 156, into the slots 152, 154, 158.

To change from the enable position to the disable position, the user actuates actuator 134 thereby causing the cable 132 to pull against the biasing member 145. This causes the latching plate 136 to rotate about the latching plate pivot axis 141, thereby disengaging the outwardly extending enable pin 156 from the first slot 152 of the latching plate 136. With the outwardly extending enable pin 156 disengaged from the first slot 152 of the latching plate 136, the user is free to pivot the swing arm mechanism 90 forward (away from the user) about pivotal connection 94 to the disabled position.

It is a further advantage of the present invention that when the swing arm assemblies 80, 90 are in the disabled position, the swing arm assemblies 80, 90 act as stationary arm grips for the user on the exercise device. In order to effectuate this, the coupling regions 86, 96 and the left and right hand-gripping portions 82, 92 of left and right swing arm mechanisms 80, 90 are advantageously shaped to provide both stationary arm grips in the disabled position and active arm action in the enabled position. Referring to FIG. 3, the swing arm assemblies 80, 90 are seen in the enabled position, wherein the user can grasp the left and right hand-gripping portions 82, 92 to exercise the upper body. Referring to FIG. 4, the swing arm assemblies 80, 90 are seen in the disabled position. The left and right hand-gripping portions 82, 92 can be grasped by the user as stationary arm grips.

To use the present invention, the user stands on the foot support portions 66, 76 and grasps the hand-gripping portions 82, 92. Initially, if the arm mechanism is in the enabled position the enabling/disabling mechanism is securely latched with the outwardly extending enable pin in the first slot of the latching plate. The user imparts a forward stepping motion on one of the foot support portions, thereby causing the transverse axle 34 to rotate in a clockwise direction (when viewed from the right side as shown in FIG. 1), due to the crank arm assemblies 40, 50 coupling the motion of the foot links 60, 70 to the rotation of the transverse axle 34. In conjunction with the lower body action, the user also imparts a substantially forward pushing motion on one of the hand-gripping portions and a substantially rearward pulling motion on the other hand-gripping portion. Due to the rotatable connection of the coupling regions 86, 96 of the swing arm mechanisms 80, 90 to the foot links 60, 70 (via the engagement assemblies 100, 110), and the rotational securement of the swing arm mechanisms 80, 90 to the forward upright member 20 of the frame 12 at their pivot points 84, 94, each hand-gripping portion moves forward as its respective foot support portion moves rearward, and vice versa.

The foot links 60, 70 are attached to the transverse axle 34 by the crank arm assemblies 40, 50 such that one foot support portion moves substantially forward as the other foot support portion moves substantially rearward. In this same fashion one hand-gripping portion moves forward as the other hand-gripping portion moves rearward (e.g., when the left hand-gripping portion 82 moves forward, the left foot support portion 66 moves rearward, while the right foot support portion 76 moves forward and the right hand-gripping portion 92 moves rearward). Therefore, the user can begin movement of the entire foot link and swing arm mechanism linkage by moving any foot support portion or hand-gripping portion, or preferably by moving all of them together.

While remaining on the exercise device, the user can alternate the arm mechanism between the enabled position and the disabled position by actuating actuator 134 and pivoting the swing arm mechanism 90. In addition, the user can adjust the guide tracks 42, 52 resulting in an adjustment of the angle of the major axis of the ellipse.

While the invention has been described with specific embodiments, other alternatives, modifications and variations will be apparent to those skilled in the art. Accordingly, it will be intended to include all such alternatives, modifications and variations set forth within the spirit and scope of the appended claims.

What is claimed is:

1. An elliptical exercise device, comprising:

a frame having a pivot axis;

a foot link having a rearward portion, a forward portion, and a foot support portion, the foot support portion having a central location;

a coupling associated with the rearward portion of the foot link for coupling the rearward portion of the foot link to the pivot axis so that the rearward portion of each foot link travels in a closed path relative to the pivot axis;

a swing arm having a pivotal connection to the frame;

an engagement mechanism having a first portion coupled to the swing arm and a second portion coupled to the foot link at a location rearward of the central location of the foot support portion, such that a force applied to the swing arm will produce a force on the foot link; and a guide system for supporting the forward portion of the foot link along a preselected reciprocating path of travel as the rearward portion of the foot link travels along its path of travel, the guide system selectably positionable in a plurality of different positions, such that when the exercise device is in use the foot support portion moves along a generally elliptical path of travel, wherein the guide system is selectably positionable at an angle from horizontal within the range of about zero degrees (0°) to about a forty degrees (40°).

2. The exercise device of claim 1, wherein the guide system includes a lift motor operably engaged to a lead screw and a follow thread.

3. An elliptical exercise device, comprising:

a frame having a pivot axis;

a foot link having a rearward portion, a forward portion, and a foot support portion, the foot support portion having a central location;

a coupling associated with the rearward portion of the foot link for coupling the rearward portion of the foot link to the pivot axis so that the rearward portion of each foot link travels in a closed path relative to the pivot axis;

a swing arm having a pivotal connection to the frame;

an engagement mechanism having a first portion coupled to the swing arm and a second portion coupled to the foot link at a location rearward of the central location of the foot support portion, such that a force applied to the swing arm will produce a force on the foot link; and a guide system for supporting the forward portion of the foot link along a preselected reciprocating path of travel as the rearward portion of the foot link travels along its path of travel, the guide system selectably positionable in a plurality of different positions, such that when the exercise device is in use the foot support portion moves along a generally elliptical path of travel, wherein the second portion of the engagement mechanism is coupled to the foot link at a location at or near the rearwardmost end of the foot support portion.

4. An elliptical exercise device, comprising:

a frame having a pivot axis;

a foot link having a rearward portion, a forward portion, and a foot support portion, the foot support portion having a central location;

a coupling associated with the rearward portion of the foot link for coupling the rearward portion of the foot link to the pivot axis so that the rearward portion of each foot link travels in a closed path relative to the pivot axis;

a swing arm having a pivotal connection to the frame;

an engagement mechanism having a first portion coupled to the swing arm and a second portion coupled to the foot link at a location rearward of the central location of the foot support portion, such that a force applied to the swing arm will produce a force on the foot link; and a guide system for supporting the forward portion of the foot link along a preselected reciprocating path of travel as the rearward portion of the foot link travels along its path of travel, the guide system selectably positionable in a plurality of different positions, such that when the exercise device is in use the foot support portion moves along a generally elliptical path of travel, further including an arm enabling/disabling mechanism operatively engaged with the swing arm, the arm enabling/disabling mechanism including an engaged position in which the swing arm is coupled to the foot link by the engagement mechanism and the arm enabling/disabling mechanism including a disengaged position in which at least a portion of the swing arm is disengaged from the foot link.

5. An elliptical exercise device, comprising:

a frame having a pivot axis;

a foot link having a rearward portion, a forward portion, and a foot support portion, the foot support portion having a central location;

a coupling associated with the rearward portion of the foot link for coupling the rearward portion of the foot link to the pivot axis so that the rearward portion of each foot link travels in a closed path relative to the pivot axis;

a swing arm having a pivotal connection to the frame;

an engagement mechanism having a first portion coupled to the swing arm and a second portion coupled to the foot link at a location rearward of the central location of the foot support portion, such that a force applied to the swing arm will produce a force on the foot link; and a guide system for supporting the forward portion of the foot link along a preselected reciprocating path of travel as the rearward portion of the foot link travels along its path of travel, the guide system selectably positionable in a plurality of different positions, such that when the exercise device is in use the foot support portion moves along a generally elliptical path of travel, further including a left swing arm and a right swing arm, a left foot link and a right foot link, a left engagement mechanism and a right engagement mechanism, and a left arm enabling/disabling mechanism and a right arm enabling/disabling mechanism.

6. An elliptical exercise device, comprising:

a frame having a pivot axis;

a foot link having a rearward portion, a forward portion, and a foot support portion, the foot support portion having a central location;

a coupling associated with the rearward portion of the foot link for coupling the rearward portion of the foot link to the pivot axis so that the rearward portion of each foot link travels in a closed path relative to the pivot axis;

a swing arm having a pivotal connection to the frame;

an engagement mechanism having a first portion coupled to the swing arm and a second portion coupled to the foot link at a location rearward of the central location of the foot support portion, such that a force applied to the swing arm will produce a force on the foot link; and a guide system for supporting the forward portion of the foot link along a preselected reciprocating path of travel as the rearward portion of the foot link travels along its path of travel, the guide system selectably positionable in a plurality of different positions, such that when the exercise device is in use the foot support portion moves along a generally elliptical path of travel wherein the guide system includes at least one guide track, wherein the foot link includes at least one roller, and wherein the guide track has an upper surface that is adapted to rollably receive the roller that reciprocally engages the guide track.

7. An elliptical exercise device, comprising:

a frame having a pivot axis;

a foot link having a rearward portion, a forward portion, and a foot support portion, the foot support portion having a central location;

a coupling associated with the rearward portion of the foot link for coupling the rearward portion of the foot link to the pivot axis so that the rearward portion of each foot link travels in a closed path relative to the pivot axis;

a swing arm having a pivotal connection to the frame;

an engagement mechanism having a first portion coupled to the swing arm and a second portion coupled to the foot link at a location rearward of the central location of the foot support portion, such that a force applied to the swing arm will produce a force on the foot link; and a guide system for supporting the forward of the foot link along a preselected reciprocating path of travel as the rearward portion of the foot link travels along its path of travel, the guide system selectably positionable in a plurality of different positions, such that when the exercise device is in use the foot support portion moves along a generally elliptical path of travel, wherein the frame comprises a longitudinal member and an upright member extending upwardly from the longitudinal member, and wherein the swing arm is pivotally connected to the upright member at a location above the longitudinal member.

8. An elliptical exercise device, comprising:

a frame having a pivot axis defined thereon, the frame configured to be supported on a floor;

first and second foot links, each foot link including a first portion and a second portion;

first and second foot supporting portions for receiving the feet of the user, the first and second foot support portions supported by the first and second foot links, respectively, and each having a central location;

a coupling associated with the first portion of each foot link for coupling the first portion of each foot link to the pivot axis so that the first portion of each foot link travels in a closed path relative to the pivot axis;

a guide associated with the frame and operative to engage and direct the second portions of the foot links along preselected reciprocating paths of travel as the first portions of the respective foot links travel along their paths of travel, so that when the exercise device is in use the foot support portion moves along a generally elliptical path of travel;

first and second swing arms each having a central portion pivotally coupled to the frame, and a lower portion; and first and second engagement mechanisms coupled to the lower portion of the first and second swing arms, respectively, and the first and second engagement mechanisms further coupled to the first and second foot links, respectively, at a location rearward of the central location of the first and second foot support portions, respectively, wherein the guide is selectably positionable at an angle from horizontal within the range of about zero degrees (0°) to about a forty degrees (40°).

9. The exercise device of claim 8, further including a guide adjustment mechanism operably coupled to the guide.

10. The exercise device of claim 9, wherein the guide adjustment mechanism includes a lift motor operably engaged to a lead screw and a follow thread.

11. An elliptical exercise device, comprising:

a frame having a pivot axis defined thereon, the frame configured to be supported on a floor;

first and second foot links, each foot link including a first portion and a second portion;

first and second foot supporting portions for receiving the feet of the user, the first and second foot support portions supported by the first and second foot links, respectively, and each having a central location; a coupling associated with the first portion of each foot link for coupling the first portion of each foot link to the pivot axis so that the first portion of each foot link travels in a closed path relative to the pivot axis;

a guide associated with the frame and operative to engage and direct the second portions of the foot links along preselected reciprocating paths of travel as the first portions of the respective foot links travel along their paths of travel, so that when the exercise device is in use the foot support portion moves along a generally elliptical path of travel;

first and second swing arms each having a central portion pivotally coupled to the frame, and a lower portion; and first and second engagement mechanisms coupled to the lower portion of the first and second swing arms, respectively, at a location rearward of the central location of the first and second foot support portions, respectively, wherein the first and second engagement mechanisms are coupled to first and second foot links at a location at or near the rearwardmost end of the first and second foot support portions, respectively.

12. An elliptical exercise device, comprising:

a frame having a pivot axis defined thereon, the frame configured to be supported on a floor;

first and second foot links, each foot link including a first portion and a second portion;

first and second foot supporting portions for receiving the feet of the user, the first and second foot support portions supported by the first and second foot links, respectively, and each having a central location; a coupling associated with the first portion of each foot link for coupling the first portion of each foot link to the pivot axis so that the first portion of each foot link travels in a closed path relative to the pivot axis;

a guide associated with the frame and operative to engage and direct the second portions of the foot links along preselected reciprocating paths of travel as the first portions of the respective foot links travel along their paths of travel, so that when the exercise device is in use the foot support portion moves along a generally elliptical path of travel;

first and second swing arms each having a central portion pivotally coupled to the frame, and a lower portion; and first and second engagement mechanisms coupled to the lower portion of the first and second swing arms, respectively, and the first and second engagement mechanisms further coupled to the first and second foot links, respectively, at a location rearward of the central location of the first and second foot support portions, respectively; and first and second arm enabling/disabling mechanisms operatively engaged with the first and second swing arms, respectively, each arm enabling/disabling mechanism including an engaged position in which the respective first and second swing arm is coupled to the respective first and second foot link by the engagement mechanism and the arm enabling/disabling mechanism including a disengaged position in which at least a portion of the respective first and second swing arm is disengaged from the respective first and second foot link.

13. An elliptical exercise device, comprising:

a frame having a pivot axis defined thereon, the frame configured to be supported on a floor;

first and second foot links, each foot link including a first portion and a second portion;

first and second foot supporting portions for receiving the feet of the user, the first and second foot support portions supported by the first and second foot links, respectively, and each having a central location; a coupling associated with the first portion of each foot link for coupling the first portion of each foot link to the pivot axis so that the first portion of each foot link travels in a closed path relative to the pivot axis;

a guide associated with the frame and operative to engage and direct the second portions of the foot links along preselected reciprocating paths of travel as the first portions of the respective foot links travel along their paths of travel, so that when the exercise device is in use the foot support portion moves along a generally elliptical path of travel;

first and second swing arms each having a central portion pivotally coupled to the frame, and a lower portion; and first and second engagement mechanisms coupled to the lower portion of the first and second swing arms, respectively, and the first and second engagement mechanisms further coupled to the first and second foot links, respectively, at a location rearward of the central location of the first and second foot support portions, respectively; and a guide track, wherein each of the first and second foot links include at least one roller, and the guide track has an upper surface that is adapted to rollably receive the foot link roller and that reciprocally engages the guide track.

14. An elliptical exercise device, comprising:

a frame having a pivot axis defined thereon, the frame configured to be supported on a floor;

first and second foot links, each foot link including a first portion and a second portion;

first and second foot supporting portions for receiving the feet of the user, the first and second foot support portions supported by the first and second foot links, respectively, and each having a central location; a coupling associated with the first portion of each foot link for coupling the first portion of each foot link to the pivot axis so that the first portion of each foot link travels in a closed path relative to the pivot axis;

a guide associated with the frame and operative to engage and direct the second portions of the foot links reciprocating paths of travel as the first portions of the respective foot links travel along their paths of travel, so that when the exercise device is in use the foot support portion moves along a generally elliptical path of travel;

first and second swing arms each having a central portion pivotally coupled to the frame, and a lower portion; and first and second engagement mechanisms coupled to the lower portion of the first and second swing arms, respectively, and the first and second engagement mechanisms further coupled to the first and second foot links, respectively, at a location rearward of the central location of the first and second foot support portions, respectively, wherein the frame comprises a longitudinal member and an upright member extending upwardly from the longitudinal member, and wherein the first and second swing arms are pivotally connected to the upright member at a location above the longitudinal member.

15. An exercise device, comprising:

a frame having a pivot axis;

a foot link having a rearward portion, a forward portion, and a foot support portion;

a coupling associated with the rearward portion of the foot link for coupling the rearward portion of the foot link to the pivot axis so that the rearward portion of the foot link is constrained to move in an orbital path; a swing arm having a pivotal connection to the frame;

an arm enabling/disabling mechanism operatively engaged with the swing arm, the arm enabling/disabling mechanism including an engaged position in which the swing arm is coupled to the foot link by the engagement mechanism and the arm enabling/disabling mechanism including a disengaged position in which at least a portion of the swing arm is disengaged from the foot link;

a selectably positionable guide system for supporting the forward portion of the foot links along a preselected reciprocating path of travel as the rearward portion of the respective foot links travel along their paths of travel, such that when the exercise device is in use the foot support portion moves along a generally elliptical path of travel; and an engagement mechanism having a first portion coupled to the swing arm and a second portion coupled to the foot link, wherein the foot support portion has a central location, and wherein the second portion of the engagement mechanism is coupled to the foot link at a location rearward of the central location of the foot support portion, such that a force applied to the swing arm will produce a force on the foot link.

16. The exercise device of claim 15, further wherein the guide system is selectably positionable at an angle from horizontal of about zero degrees (0°) to about a forty degrees (40°).

17. The exercise device of claim 15, wherein the second portion of the engagement mechanism is coupled to foot link at a location at or near the rearwardmost end of the foot support portion.

18. The exercise device of claim 15, further including a left swing arm and a right swing arm, a left foot link and a right foot link, a left engagement mechanism and a right engagement mechanism, and a left arm enabling/disabling mechanism and a right arm enabling/disabling mechanism.

19. The exercise device of claim 15 further including a guide track, wherein the foot link includes at least one roller, and the guide track has an upper surface that is adapted to rollably receive the foot link roller and that reciprocally engages the guide track.

* * * * *